US005723243A

United States Patent [19]

Sasaki et al.

[11] Patent Number: 5,723,243

[45] Date of Patent: Mar. 3, 1998

[54] ELECTROPHOTOGRAPHIC PHOTOCONDUCTOR AND AROMATIC POLYCARBONATE RESIN FOR USE THEREIN

[75] Inventors: Masaomi Sasaki; Hiroshi Tamura, both of Susono; Tomoyuki Shimada, Shizuoka-ken; Tetsuro Suzuki, Fuji; Chiaki Tanaka, Shizuoka-ken; Kouji Kishida, Shizuoka-ken; Akira Katayama, Shizuoka-ken; Kazukiyo Nagai; Chihaya Adachi, both of Numazu; Nozomu Tamoto, Tokyo; Mitsutoshi Anzai; Akihiro Imai, both of Kawasaki, all of Japan

[73] Assignees: Ricoh Company, Ltd., Tokyo; Hodogaya Chemical Co., Ltd., Kawasaki, both of Japan

[21] Appl. No.: 648,759

[22] Filed: May 16, 1996

[30] Foreign Application Priority Data

| | | | |
|---|---|---|---|
| May 16, 1995 | [JP] | Japan | 7-141290 |
| Jul. 12, 1995 | [JP] | Japan | 7-176189 |
| Jul. 13, 1995 | [JP] | Japan | 7-177402 |
| Dec. 25, 1995 | [JP] | Japan | 7-336739 |
| May 15, 1996 | [JP] | Japan | 8-120296 |
| May 15, 1996 | [JP] | Japan | 8-120298 |
| May 16, 1996 | [JP] | Japan | 8-146601 |

[51] Int. Cl.[6] ..... G03G 5/00

[52] U.S. Cl. ..... 430/96; 430/59; 430/83; 525/400

[58] Field of Search ..... 430/96, 59, 83; 525/400

[56] References Cited

U.S. PATENT DOCUMENTS

| | | | |
|---|---|---|---|
| 5,141,832 | 8/1992 | Takegawa et al. | 430/96 |
| 5,213,924 | 5/1993 | Sakamoto | 430/96 |
| 5,292,607 | 3/1994 | Aso et al. | 430/96 |
| 5,378,567 | 1/1995 | Nozomi et al. | 430/96 |

*Primary Examiner*—Mark Chapman

*Attorney, Agent, or Firm*—Oblon, Spivak, McClelland, Maier & Neustadt, P.C.

[57] ABSTRACT

An electrophotographic photoconductor includes an electroconductive support, and a photoconductive layer formed thereon containing as an effective component an aromatic polycarbonate resin having a repeat unit of formula (I), or two repeat units of formula (II) and formula (III):

(I)

wherein n, $Ar^1$, $Ar^2$, $Ar^3$, $R^1$, $R^2$ and X are as specified in the specification, (II)

(III)

wherein k and j are also as specified in the specification.

44 Claims, 9 Drawing Sheets

ELECTROPHOTOGRAPHIC PHOTOCONDUCTOR AND AROMATIC POLYCARBONATE RESIN FOR USE THEREIN

BACKGROUND OF THE INVENTION

1. Field of the Invention

The present invention relates to an electrophotographic photoconductor comprising an electroconductive support, and a photoconductive layer formed thereon, comprising an aromatic polycarbonate resin as an effective component. In addition, the present invention also relates to the above-mentioned aromatic polycarbonate resin with charge transporting properties.

2. Discussion of Background

Recently organic photoconductors are used in many copying machines and printers. These organic photoconductors have a layered structure comprising a charge generation layer (CGL) and a charge transport layer (CTL) which are successively overlaid on an electroconductive support. The charge transport layer (CTL) is a film-shaped layer comprising a binder resin and a low-molecular-weight charge transport material (CTM) dissolved therein. The addition of such a low-molecular-weight charge transport material (CTM) to the binder resin lowers the intrinsic mechanical strength of the binder resin, so that the CTL film is fragile and has a low tensile strength. Such lowering of the mechanical strength of the CTL causes the wearing of the photoconductor or forms scratches and cracks in the surface of the photoconductor.

Although some vinyl polymers such as polyvinyl anthracene, polyvinyl pyrene and poly-N-vinylcarbazole have been studied as high-molecular-weight photoconductive materials for forming a charge transporting complex for use in the conventional organic photoconductor, such polymers are not satisfactory from the viewpoint of photosensitivity.

In addition, high-molecular-weight materials having charge transporting properties have been also studied to eliminate the shortcomings of the above-mentioned layered photoconductor. For instance, there are proposed an acrylic resin having a triphenylamine structure as reported by M. Stolka et al., in "J. Polym. Sci., vol 21, 969 (1983)"; a vinyl polymer having a hydrazone structure as described in "Japan Hard Copy '89 p. 67"; and polycarbonate resins having a triarylamine structure as disclosed in U.S. Pat. Nos. 4,801,517, 4,806,443, 4,806,444, 4,937,165, 4,959,288, 5,030,532, 5,034,296, and 5,080,989, and Japanese Laid-Open Patent Applications Nos. 64-9964, 3-221522, 2-304456, 4-11627, 4-175337, 4-18371, 4-31404, and 4-133065. However, any materials have not yet been put to practical use.

According to the report of "Physical Review B46 6705 (1992)" by M. A. Abkowitz et al., It is confirmed that the drift mobility of a high-molecular weight charge transporting material is lower than that of a low-molecular weight material by one figure. This report is based on the comparison between the photoconductor comprising a low-molecular weight tetraarylbenzidine derivative dispersed in the photoconductive layer and the one comprising a high-molecular polycarbonate having a tetraarylbenzidine structure in its molecule. The reason for this has not been clarified, but it is suggested that the photoconductor employing the high-molecular weight charge transporting material produces poor results in terms of the photosensitivity and the residual potential although the mechanical strength of the photoconductor is improved.

Conventionally known representative aromatic polycarbonates are obtained by allowing 2,2-bis(4-hydroxyphenyl) propane (hereinafter referred to as bisphenol A) to react with a carbonate precursor material such as phosgene or diphenylcarbonate. Such polycarbonates made from bisphenol A are used in many fields because of excellent characteristics, such as high transparency, high heat resistance, high dimensional accuracy, and high mechanical strength.

For example, this kind of polycarbonate resin is intensively studied as a binder resin for use in an organic photoconductor in the field of electrophotography. A variety of aromatic polycarbonate resins have been proposed as the binder resins for use in the charge transport later of the layered photoconductor.

As previously mentioned, however, the mechanical strength of the aforementioned aromatic polycarbonate resin is decreased by the addition of the low-molecular-weight charge transporting material in the charge transport layer of the layered electrophotographic photoconductor.

SUMMARY OF THE INVENTION

It is therefore a first object of the present invention to provide an electrophotographic photoconductor free from the conventional shortcomings, which can show high photosensitivity and high durability.

A second object of the present invention is to provide an aromatic polycarbonate resin that is remarkably useful as a high-molecular-weight charge transporting material for use in an organic electrophotographic photoconducnor.

The above-mentioned first object of the present invention can be achieved by an electrophotographic photoconductor comprising an electroconductive support, and a photoconductive layer formed thereon comprising as an effective component an aromatic polycarbonate resin having a repeat unit of formula (I):

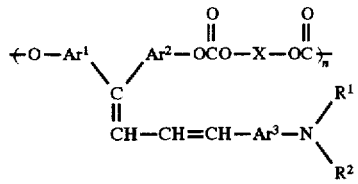

(I)

wherein n is an integer of 5 to 5000; $Ar^1$, $Ar^2$ and $Ar^3$ each may be the same or different, and is a bivalent aromatic hydrocarbon group; $R^1$ and $R^2$ each may be the same or different, and is an acyl group, an alkyl group which may have a substituent, an aromatic hydrocarbon group which may have a substituent, or a heterocyclic group which may have a substituent; and X is a bivalent aliphatic group, a bivalent cyclic aliphatic group, or

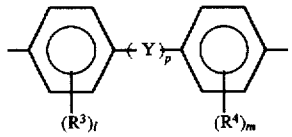

in which $R^3$ and $R^4$ each is an alkyl group which may have a substituent, an aromatic hydrocarbon group which may have a substituent, or a halogen atom; l and m each is an integer of 0 to 4; and p is an integer of 0 or 1, and when p=1, Y is a straight-chain, branched or cyclic alkylene group having 1 to 12 carbon atoms, —O—, —S—, —SO—, —$SO_2$—.

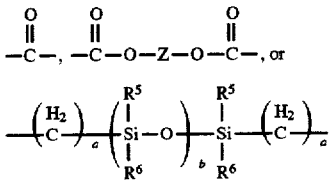

in which Z is a bivalent aliphatic hydrocarbon group; a is an integer of 0 to 20; b is an integer of 1 to 2000; and $R^5$ and $R^6$ each is an alkyl group which may have a substituent or an aromatic hydrocarbon group which may have a substituent.

In the above-mentioned electrophotographic photoconductor, each of $Ar^1$, $Ar^2$ and $Ar^3$ may be phenylene group in the repeat unit of formula (I) for use in the aromatic polycarbonate resin.

The first object of the present invention can also be achieved by an electrophotographic photoconductor comprising an electroconductive support and a photoconductive layer formed thereon comprising as an effective component an aromatic polycarbonate resin having a repeat unit of formula (II) and a repeat unit of formula (III), with the composition ratio of the repeat unit of formula (II) to the repeat unit of formula (III) being in the relationship of $0<k/(k+j)\leqq 1$:

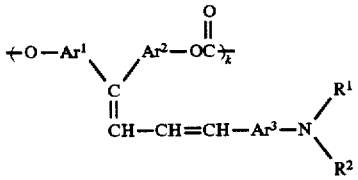

(II)

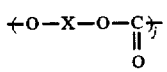

(III)

wherein k is an integer of 5 to 5000; j is an integer of 0 to 5000; $Ar^1$, $Ar^2$ and $Ar^3$ each may be the same or different, and is a bivalent aromatic hydrocarbon group; $R^1$ and $R^2$ each may be the same or different, and is an acyl group, an alkyl group which may have substituent, an aromatic hydrocarbon group which may have a substituent, or a heterocyclic group which may have a substituent; and X is a bivalent aliphatic group, a bivalent cyclic aliphatic group, or

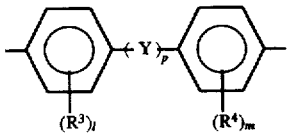

in which $R^3$ and $R^4$ each is an alkyl group which may have a substituent, an aromatic hydrocarbon group which may have a substituent, or a halogen atom; l and m each is an integer of 0 to 4; and p is an integer of 0 or 1, and when p=1, Y is a straight-chain, branched or cyclic alkylene group having 1 to 12 carbon atoms, —O—, —S—, —SO—, $—SO_2—$,

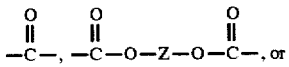

-continued

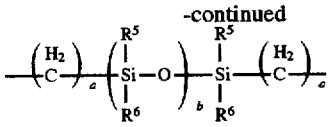

in which Z is a bivalent aliphatic hydrocarbon group; a is an integer of 0 to 20; b is an integer of 1 to 2000; and $R^5$ and $R^6$ each is an alkyl group which may have a substituent or an aromatic hydrocarbon group which may have a substituent. In the above-mentioned electrophotographic photoconductor, each of $Ar^1$, $Ar^2$ and $Ar^3$ may be phenylene group in the repeat unit of formula (II).

The second object of the present invention can be achieved by an aromatic polycarbonate resin having a repeat unit of formula (I):

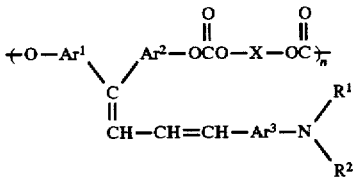

(I)

wherein n is an integer of 5 to 5000; $Ar^1$ $Ar^2$ and $Ar^3$ each may be the same or different, and is a bivalent aromatic hydrocarbon group; $R^1$ and $R^2$ each may be the same or different, and is an acyl group, an alkyl group which may have a substituent, an aromatic hydrocarbon group which may have a substituent, or a heterocyclic group which may have a substituent; and X is a bivalent aliphatic group, a bivalent cyclic aliphatic group, or

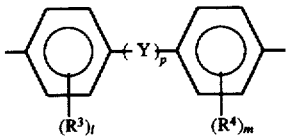

in which $R^3$ and $R^4$ each is an alkyl group which may have a substituent, an aromatic hydrocarbon group which may have a substituent, or a halogen atom; l and m each is an integer of 0 to 4; and p is an integer of 0 or 1, and when p=1, Y is a straight-chain, branched or cyclic alkylene group having 1 to 12 carbon atoms, —O—, —S—, —SO—, $—SO_2—$,

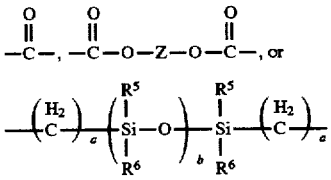

in which Z is a bivalent aliphatic hydrocarbon group; a is an integer of 0 to 20; b is an integer of 1 to 2000; and $R^5$ and $R^6$ each is an alkyl group which may have a substituent or an aromatic hydrocarbon group which may have a substituent.

In the above-mentioned aromatic polycarbonate resin, each of $Ar^1$, $Ar^2$ and $Ar^3$ may be phenylene group in the repeat unit of formula (I).

The second object of the present invention can also be achieved by an aromatic polycarbonate resin having a repeat unit of formula (II) and a repeat unit of formula (III), with the composition ratio of the repeat unit of formula (II) to the repeat unit of formula (III) being in the relationship of $0<k/(k+j)\leqq 1$:

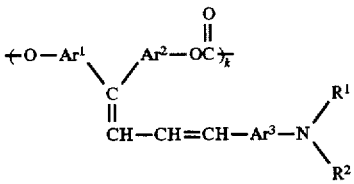

(II)

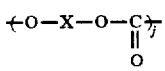

(III)

wherein k is an integer of 5 to 5000; j is an integer of 0 to 5000; $Ar^1$, $Ar^2$ and $Ar^3$ each may be the same or different, and is a bivalent aromatic hydrocarbon group; $R^1$ and $R^2$ each may the same or different, and is an acyl group, an alkyl group which may have a substituent, an aromatic hydrocarbon group which may have a substituent, or a heterocyclic group which may have a substituent; and X is a bivalent aliphatic group, a bivalent cyclic aliphatic group, or

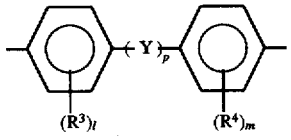

in which $R^3$ and $R^4$ each is an alkyl group which may have a substituent, an aromatic hydrocarbon group which may have a substituent, or a halogen atom; l and m each is an integer of 0 to 4; and p is an integer of 0 or 1, and when p=1, Y is a straight-chain, branched or cyclic alkylene group having 1 to 12 carbon atoms, —O—, —S—, —SO—, —$SO_2$—,

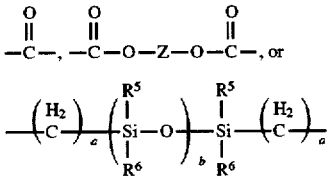

in which Z is a bivalent aliphatic hydrocarbon group; a is an integer of 0 to 20; b is an integer of 1 to 2000; and $R^5$ and $R^6$ each is an alkyl group which may have a substituent or an aromatic hydrocarbon group which may have a substituent.

In the above-mentioned aromatic polycarbonate resin, each of $Ar^1$, $Ar^2$ and $Ar^3$ may be phenylene group in the repeat unit of formula (II).

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
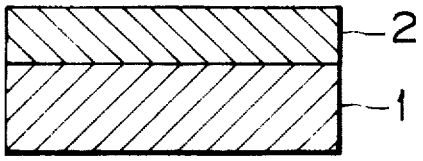
FIG. 1 is a schematic cross-sectional view of a first example of an electrophotographic photoconductor according to the present invention.

The electrophotographic photoconductor according to the present invention comprises a photoconductive layer comprising (I) an aromatic polycarbonate resin having a repeat unit with a triarylamine structure, represented by formula (I), or (II) an aromatic polycarbonate resin having a repeat unit with a triarylamine structure, represented by formula (II) and a repeat unit of formula (III). Those aromatic polycarbonate resins, which are novel compounds, have charge transporting properties and high mechanical strength, so that the photoconductor of the present invention can exhibit high photosensitivity and excellent durability.

Further, it is preferable that $Ar^1$, $Ar^2$ and $Ar^3$ each be phenylene group in the repeat unit of formula (I), which is represented by the following formula (IV):

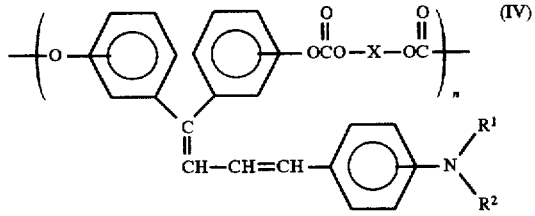

(IV)

wherein n, $R^1$, $R^2$ and X are the same as those previously defined in formula (I).

It is preferable that $Ar^1$, $Ar^2$ and $Ar^3$ each be phenylene group in the repeat unit of formula (II), which represented by the following formula (V):

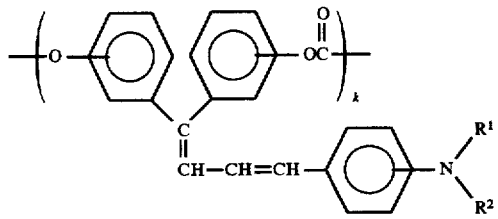

(V)

wherein k, $R^1$, and $R^2$ are the same as those previously defined in formula (II).

Those aromatic polycarbonate resins according to the present invention can be obtained by the method of synthesizing a conventional polycarbonate resin, that is, polymerization of a bisphenol and a carbonic acid derivative.

To be more specific, the aromatic polycarbonate resin comprising the repeat unit of formula (II) or (V) of the present invention can be produced by the ester interchange between a diol having amino group represented by the following formula (VI) or (VII) and a bisarylcarbonate compound, or by the polymerization of the diol of formula (VI) or (VII) with phosgene in accordance with solution polymerization or interfacial polymerization:

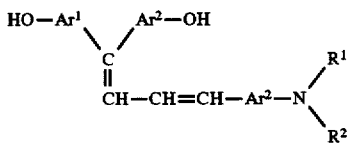

(VI)

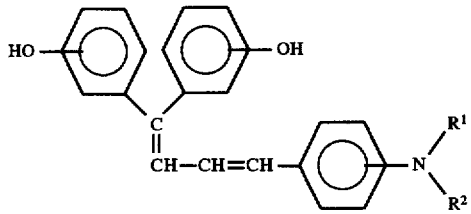

(VII)

wherein $Ar^1$, $Ar^2$, $Ar^3$, $R^1$ and $R^2$ are the same as those previously defined in formula (II).

When a diol of the following formula (VIII) is employed in combination with the diol of formula (VI) or (VII) in the course of the polymerization with the phosgene, the aromatic polycarbonate resin of the present invention comprising the repeat units of formulae (II) and (III), or the aromatic polycarbonate resin of the present invention comprising the repeat unit of formulae (V) and (III):

OH—X—OH (VIII)

wherein X is the same as that previously defined in formula (III).

By such a synthesis method, the aromatic polycarbonate resin provided with the desired characteristics can be obtained. Further, the composition ratio of the repeat unit of formula (II) to the repeat unit of formula (III), or that of the repeat unit of formula (V) to the repeat unit of formula (III) can be selected within a wide range in light of the desired characteristics of the obtained aromatic polycarbonate resin.

The aromatic polycarbonate resin of the present invention comprising the repeat unit of formula (I) or (IV) can be obtained by polymerizing the diol of formula (VI) or (VII) with a bischloroformate compound derived from the diol of formula (VIII) in accordance with solution polymerization or interfacial polymerization. Alternatively, the above-mentioned aromatic polycarbonate resin can also be obtained by polymerizing a bischloroformate derived from the diol of formula (VI) or (VII) with the diol of formula (VIII).

According to he ester interchange method, a dihydric phenol and a bisarylcarbonate compound are mixed in the presence of an inert gas, and the polymerization reaction is generally carried out at temperature in the range of 120° to 350° C. under reduced pressure. The pressure in the reaction system is stepwise reduced to 1 mmHg or less in order to distill away the phenols generated during the reaction from the reaction system. The reaction is commonly terminated in about one to 4 hours. When necessary, a molecular weight modifier and an antioxidant may be added to the reaction system. As the bisarylcarbonate compound, diphenyl carbonate, di-p-tolyl carbonate, phenyl-p-tolyl carbonate, di-p-chlorophenyl carbonate and dinaphthyl carbonate can be employed.

The polymerization of a diol with the phosgene is commonly carried of in the presence of an agent for deacidifying and a solvent. In this case, hydroxides of alkali metals such as sodium hydroxide and potassium hydroxide, and pyridine can be used as the deacidifying agents in the above reaction. As the solvent, halogenated hydrocarbon solvents such as dichloromethane and chlorobenzene can be employed. In addition, a catalyst such as tertiary amine or a quaternary ammonium salt may be used to accelerate the reaction speed. Furthermore, it is also desirable to use phenol or p-tert-butylphenol as a molecular weight modifier. The polymerization reaction is generally carried out at temperature in the range of 0° to 40° C. In this case, the polymerization is terminated in several minutes to 5 hours. It is desirable to maintain the reaction system to pH 10 or more.

In the case of the polymerization of a diol with a bischloroformate compound, the diol is dissolved in a proper solvent to prepare a solution of the diol, and a deacidifying agent and the bischloroformate compound are added to the above prepared diol solution. In this case, tertiary amine compounds such as trimethylamine, triethylamine and tripropylamine, and pyridine can be used as the deacidifying agents. Examples of the solvent for use in the above-mentioned polymerization reaction are halogenated hydrocarbon solvents such as dichloromethane, dichloroethane, trichloroethane, tetrachloroethane, trichloroethylene, and chloroform; and cyclic ethers such as tetrahydrofuran and dioxane. In addition, it is desirable to use phenol or p-tert-butylphenol as a molecular weight modifier. The reaction temperatures is generally in the range of 0° to 40° C. In this case, the polymerization is generally terminated in several minutes to 5 hours.

It is preferable that the aromatic polycarbonate resin according to the present invention thus obtained have a number-average molecular weight of 1,000 to 1,000,000, more preferably in the range of 5,000 to 500,000 when expressed by the styrene-reduced value.

To the aromatic polycarbonate resin produced by the previously mentioned methods, various additives such as an antioxidant, a light stabilizer, a thermal stabilizer, a lubricant and a plasticizer can be added when necessary.

The diol having a tertiary amine group represented by the formula (VI) or (VII), which is an intermediate for preparation of the aromatic polycarbonate resin according to the present invention, will now be explained in detail.

In the formulae (VI) and (VII), as previously mentioned, $R^1$ and $R^2$ each may be the same or different, and is an acyl group, an alkyl group which may have a substituent, an aromatic hydrocarbon group which may have a substituent, or a heterocyclic group which may have a substituent.

Examples of the acyl group, the alkyl group, the aromatic hydrocarbon group, and the heterocyclic group, represented by $R^1$ and $R^2$ are as follows:

(1) in acyl group: acetyl group, propionyl group, and benzoyl group.

(2) in alkyl group: a straight-chain or branched alkyl group having 1 to 5 carbon atoms. The above alkyl group may have a substituent such as a fluorine atom, cyano group, or a phenyl group which may have a substituent selected from the group consisting of a halogen atom and an alkyl group having 1 to 5 carbon atoms.

Specific examples of the above alkyl group include methyl group, ethyl group, n-propyl group, I-propyl group, tert-butyl group, sec-butyl group, n-butyl group, I-butyl group, trifluoromethyl group, 2-cyanoethyl group, benzyl group, 4-chlorobenzyl group, and 4-methylbenzyl group.

(3) in aromatic hydrocarbon group: there can be employed phenyl group, a fused polycyclic hydrocarbon group, and a non-fused polycyclic hydrocarbon group.

Examples of the fused polycyclic hydrocarbon group are naphthyl group, pyrenyl group, 2-fluorenyl group, 9,9-dimethyl-2-fluorenyl group, azulenyl group, anthryl group, triphenylenyl group, chrysenyl group, fluorenylidenephenyl group, and 5H-dibenzo[a,d]cycloheptenylidenephenyl group.

Examples of the non-fused polycyclic hydrocarbon group include biphenylyl group, terphenylyl group and a group represented by formula (IX):

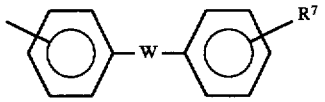

(IX)

wherein $R^7$ is the same as the substituents of the aromatic hydrocarbon group or the heterocyclic group represented by $R^1$ and $R^2$, which will be described later; and W is —O—, —S—, —SO—, —$SO_2$—, —CO—, and the following bivalent groups:

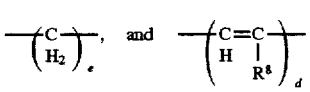

in which c is an integer of 1 to 12; d is an integer of 1 to 3; and $R^8$ is a hydrogen atom, an alkyl group which may have a substituent, or an aromatic hydrocarbon group which may have a substituent.

(4) A heterocyclic group: thienyl group, benzothienyl group, furyl group, benzofuranyl group, and carbazolyl group.

In the diol of formula (VI), $Ar^1$, $Ar^2$ and $Ar^3$ each is a bivalent aromatic hydrocarbon group. In this case, there can be employed any bivalent groups derived from the aromatic hydrocarbon group represented by $R^1$ and $R^2$.

The above-mentioned aromatic hydrocarbon group and the heterocyclic group represented by $R^1$ and $R^2$ may have any of the following substituents:

(1) A halogen atom, cyano group, and nitro group.

(2) An alkyl group, preferably a straight chain or branched alkyl group having 1 to 12 carbon atom, more preferably having 1 to 8 carbon atoms, further preferably having 1 to 4 carbon atoms. The alkyl group may have a substituent such as a fluorine atom, hydroxyl group, cyano group, an alkoxyl group having 1 to 4 carbon atoms, or a phenyl group which may have a substituent selected from the group consisting of a halogen atom, an alkyl group having 1 to 4 carbon atoms, and an alkoxyl group having 1 to 4 carbon atoms.

Specific examples of such an alkyl group are methyl group, ethyl group, n-propyl group, I-propyl group, t-butyl group, s-butyl group, n-butyl group, I-butyl group, trifluoromethyl group, 2-hydroxyethyl group, 2-cyanoethyl group, 2-ethoxyethyl group, 2-methoxyethyl group, benzyl group, 4-chlorobenzyl group, 4-methylbenzyl group, and 4-methoxybenzyl group.

(3) An alkoxyl group (—$OR^{20}$) in which $R^{20}$ is the same alkyl group as previously defined in (2).

Specific examples of such an alkoxyl group are methoxy group, ethoxy group, n-propoxy group, I-propoxy group, t-butoxy group, n-butoxy group, s-butoxy group, I-butoxy group, 2-hydroxyethoxy group, 2-cyanoethoxy group, benzyloxy group, 4-methylbenzyloxy group, and trifluoromethoxy group.

(4) An aryloxy group. Examples of the aryl group in the aryloxy group are phenyl group end naphthyl group. The aryloxy group may have a substituent such as an alkoxyl group having 1 to 4 carbon atoms, an alkyl group having 1 to 4 carbon atoms, or a halogen atom.

Specific examples of the aryloxy group are phenoxy group, 1-naphthyloxy group, 2-naphthyloxy group, 4-methylphenoxy group, 4-methoxyphenoxy group, 4-chlorophenoxy group, and 6-methyl-2-naphthyloxy group.

(5) A substituted mercapto group or an arylmercapto group. Specific examples of the substituted mercapto group or arylmercapto group are methylthio group, ethylthio group, phenylthio group, and p-methylphenylthio group.

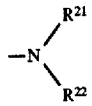

(6)

in which $R^{21}$ and $R^{22}$ each is the same alkyl group as defined in (2), or an aryl group such as phenyl group, biphenylyl group, or naphthyl group, which may have a substituent such as an alkoxyl group having 1 to 4 carbon atoms, an alkyl group having 1 to 4 carbon atoms, or a halogen atom. $R^{21}$ and $R^{22}$ may form a ring in combination with a carbon atom in the aryl group.

Specific examples of this amino derivative group are diethyl amino group, N-methyl-N-phenylamino group, N,N-diphenylamino group, N,N-di (p-tolyl)amino group, dibenzylamino group, piperidino group, morpholino group, and julolidyl group.

(7) An alkylenedioxy group such as methylenedioxy group, or an alkylenedithio group such as methylenedithio group.

Examples of the diol represented by formula (VIII) include aliphatic diols such as 1,3-propanediol, 1,4-butanediol, 1,5-pentanediol, 1,6-hexanediol, 1,8-octanediol, 1,10-decanediol, 2-methyl-1,3-propanediol, 2,2-dimethyl-1,3-propanediol, 2-ethyl-1,3-propanediol, diethylene glycol, triethylene glycol, polyethylene glycol and polytetramethylene ether glycol; and cyclic aliphatic diols such as 1,4-cyclohexanediol, 1,3-cyclohexanediol and cyclohexane-1,4-dimethanol.

Examples of the diol having an aromatic ring are as follows: 4,4'-dihydroxydiphenyl, bis(4-hydroxyphenyl) methane, 1,1-bis(4-hydroxyphenyl)ethane, 1,1-bis(4-hydroxyphenyl)-1-phenylethane, 2,2-bis(4-hydroxyphenyl) propane, 2,2-bis(3-methyl-4-hydroxyphenyl)propane, 1,1-bis(4-hydroxyphenyl)cyclohexane, 1,1-bis(4-hydroxyphenyl)cyclopentane, 2,2-bis(3-phenyl-4-hydroxyphenyl)propane, 2,2-bis(3-isopropyl-4-hydroxyphenyl)propane, 2,2-bis(4-hydroxyphenyl)butane, 2,2-bis(3,5-dimethyl-4-hydroxyphenyl)propane, 2,2-bis(3,5-dibromo-4-hydroxyphenyl)propane, 4,4'-dihydroxydiphenylsulfone, 4,4'-dihydroxydiphenylsulfoxide, 4,4'-dihydroxydiphenylsulfide, 3,3'-dimethyl-4,4'-dihydroxydiphenylsulfide, 4,4'-dihydroxydiphenyloxide, 2,2-bis(4-hydroxyphenyl)hexafluoropropane, 9,9-bis(4-hydroxyphenyl)fluorene, 9,9-bis(4-hydroxyphenyl)xanthene, ethylene glycol-bis(4-hydroxybenzoate), diethylene glycol-bis(4-hydroxybenzoate), triethylene glycol-bis(4-hydroxybenzoate), 1,3-bis(4-hydroxyphenyl)-tetramethyl disiloxane, and phenol-modified silicone oil.

Of the diols represented by formulae (VI) and (VII), the following conjugated diene compounds (XI) to (XIV) are novel compounds:

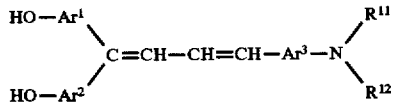

(XI)

wherein $R^{11}$ and $R^{12}$ each is a hydrogen atom, an acyl group, an alkyl group which may have a substituent, or an aryl group which may have a substituent; and $Ar^1$, $Ar^2$ and $Ar^3$ each is an arylene group.

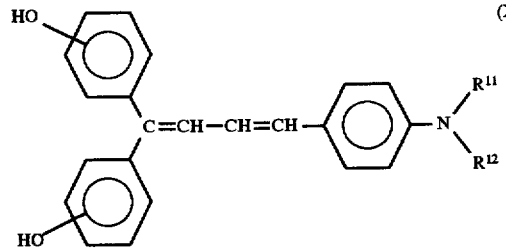

(XII)

wherein $R^{11}$ and $R^{12}$ each is a hydrogen atom, an acyl group, an alkyl group which may have a substituent, or an aryl group which may have a substituent.

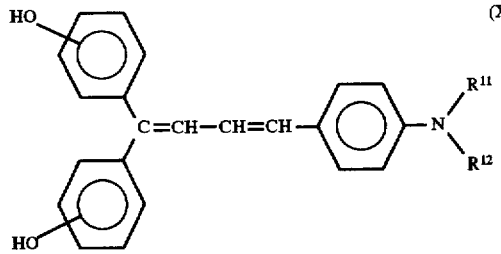

(XIII)

wherein $R^{11}$ and $R^{12}$ each is a hydrogen atom, an acyl group, an alkyl group which may have a substituent, or an aryl group which may have a substituent.

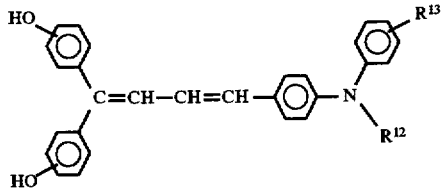

(XIV)

wherein $R^{12}$ is a hydrogen atom, an acyl group, an alkyl group which may have a substituent, or an aryl group which may have a substituent; and $R^{15}$ is a hydrogen atom, an alkyl group which may have a substituent, an aryl group which may have a substituent, an alkoxyl group, or a halogen atom.

Namely, conjugated diene compounds can be used as intermediates for preparation of the aromatic polycarbonate resins according to the present invention.

In those formulae (XI) to (XIV), the alkyl group represented by $R^{11}$, $R^{12}$ and $R^{15}$ is a straight-chain or branched alkyl group having 1 to 5 carbon atoms. The above alkyl group may have a substituent such as a fluorine atom, cyano group, or a phenyl group which may have a substituent selected from the group consisting of a halogen atom and an alkyl group having 1 to 5 carbon atoms.

Specific examples of the above alkyl group include methyl group, ethyl group, n-propyl group, I-propyl group, tert-butyl group, sec-butyl group, n-butyl group, I-butyl group, trifluoromethyl group, 2-cyanoethyl group, benzyl group, 4-chlorobenzyl group, and 4-methylbenzyl group.

Examples of the aryl group represented by $R^{11}$, $R^{12}$, and $R^{15}$ are phenyl group, naphthyl group, biphenylyl group, terphenylyl group, pyrenyl group, fluorenyl group, 9,9-dimethyl-2-fluorenyl group, azulenyl group, anthryl group, triphenylenyl group, and chrysenyl group.

The above-mentioned aryl group may have a substituent such as a lower alkyl group, a lower alkoxyl group or a halogen atom.

Examples of the acyl group represented by $R^{11}$ and $R^{12}$ are acetyl group, propionyl group, and benzoyl group.

Examples of the halogen atom represented by $R^{15}$ in formula (XIV) include a fluorine atom, a chlorine atom, a bromine atom, and an iodine atom.

As the alkoxyl group represented by $R^{15}$ in formula (XIV), any alkoxyl group derived from the aforementioned alkyl group can be employed.

As the arylene group represented by $Ar^1$, $Ar^2$ and $Ar^3$ in formula (XI), any bivalent group derived from the aforementioned aryl group can be employed.

The conjugated diene compound of formula (XI) can be derived from a conjugated diene compound of the following formula (X), which is also a novel compound, by cleavage of an ether moiety or hydrolysis of an ester moiety, using an acid reagent or basic reagent:

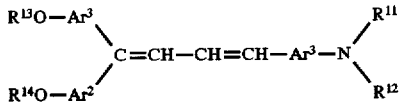

(X)

wherein $R^{11}$ and $R^{12}$ each is a hydrogen atom, an acyl group, an alkyl group which may have a substituent, or an aryl group which may have a substituent; $R^{13}$ and $R^{14}$ each is an alkyl group which may have a substituent, or an acyl group; and $Ar^1$, $Ar^2$ and $Ar^3$ each is an arylene group.

Specific examples of the acid reagent include hydrogen bromide, hydrogen iodide, trifluoroacetic acid, hydrochloride of pyridine, concentrated hydrochloric acid, magnesium iodide ethylate, aluminum chloride, aluminum bromide, boron tribromide, boron trichloride, and boron triiodide.

Specific examples of the basic reagent include potassium hydroxide, sodium hydroxide, sodium, lithium, sodium iodide, lithium iodide, lithium diphenyl phosphide, and sodium thiolate.

Specific examples of the solvent used for the preparation of the conjugated diene compound of formula (XI) from the conjugated diene compound of formula (X) are acetic anhydride, dichloromethane, tetrahydrofuran, dimethylformamide, pyridine, and butanol.

In this case, the reaction temperature, which depends on the reactivity of the reagent to be employed, is generally in the range of room temperature to 200° C.

Particularly, when $R^{13}$ and $R^{14}$ each is an acyl group in the conjugated diene compound of formula (X), the diol compound of formula (XI) can be derived therefrom by allowing the conjugated diene compound of formula (X) to react with a corresponding acyl halide in the presence of an acid trapping agent.

The above-mentioned conjugated diene compound of formula (X) can be produced by the following methods:

(1) In the case where $R^{11}$ and $R^{12}$ in formula (X) represent the same alkyl group which may have a substituent, a primary amine compound of the following formula (XV) is allowed to react with a corresponding halogenated alkyl, dialkyl sulfate, or sulfonate in the presence of an acid trapping agent such is an alkaline material.

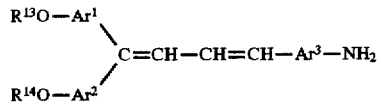

(XV)

wherein $R^{13}$, $R^{14}$, $Ar^1$, $Ar^2$ and $Ar^3$ are the same as those previously defined in formula (X).

(2) In the case where $R^{11}$ and $R^{12}$ in formula (X) represent the same aryl group which may have a substituent, the above-mentioned primary amine compound of formula (XV) is allowed to react with a corresponding halogenated aryl at temperature of 150° to 250° C. in a stream of nitrogen in the presence of an alkaline material, and copper powder, copper oxide, or halogenated copper. In this case, a solvent may be used or not.

Specific examples of the alkaline material used in the above-mentioned reaction include sodium hydroxide, potassium hydroxide, sodium carbonate and potassium carbonate.

When the above-mentioned reaction is carried out using a solvent, nitrobenzene, dichlorobenzene, quinoline, N,N-dimethylformamide, dimethyl sulfoxide, N-methyl pyrrolidone, and 1,3-dimethyl-2-imidazolidinone can be employed as the solvent.

(3) In the case where $R^{11}$ and $R^{12}$ in formula (X) are different, and each represents an alkyl group of an aryl group, which may have a substituent, the above-mentioned primary amine compound of formula (XV) is protected by an acyl group. The thus protected primary amine compound is allowed to react with one of a corresponding halogenated alkyl or a corresponding halogenated aryl, followed by the hydrolysis reaction at the first step. Next, the resulting reaction product is allowed to react with the halogenated alkyl or halogenated aryl which has not yet been employed in the step. The condition in the reaction with the halogenated alkyl or those with the halogenated aryl are the same as those previously mentioned.

For instance, to prepare a conjugated diene compound of formula (X) in which $R^{11}$ is a substituted or unsubstituted alkyl group and $R^{12}$ is a substituted or unsubstituted aryl group, the previously mentioned N-acyl compound obtained by protecting the primary amine compound by an acyl group may be allowed to react with a halogenated aryl, followed by the hydrolysis reaction. Thereafter, the obtained reaction product may be allowed to react with an agent for providing a nitrogen atom with an alkyl group.

In the photoconductors according to the present invention, at least one of the previously mentioned aromatic polycarbonate resins is contained in the photoconductive layers 2, 2a, 2b, 2c, 2d, and 2e. The aromatic polycarbonate resin can be employed in different ways, for example, as shown in FIGS. 1 through 6.

In the photoconductor as shown in FIG. 1, a photoconductive layer 2 is formed on an electroconductive support 1, which photoconductive layer 2 comprises an aromatic polycarbonate resin of the present invention and a sensitizing dye, with the addition thereto of a binder agent (binder resin) when necessary. In this photoconductor, the aromatic polycarbonate resin works as a photoconductive material, through which charge carriers which are necessary for the light decay of the photoconductor are generated and transported. However, the aromatic polycarbonate resin itself scarcely absorbs light in the visible light range and, therefore, it is necessary to add a sensitizing dye which absorbs light in the visible light range in order to form latent electrostatic images by use of visible light.

Figure 2:
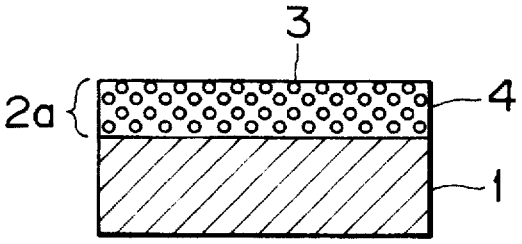
FIG. 2 is a schematic cross-sectional view of a second example of an electrophotographic photoconductor according to the present invention.

Referring to FIG. 2, there is shown an enlarged cross-sectional view of another embodiment of an electrophotographic photoconductor according to the present invention. In this photoconductor, there is formed a photoconductive layer 2a on an electroconductive support 1. The photoconductive layer 2a comprises a charge transport medium 4 comprising (I) an aromatic polycarbonate resin of the present invention, optionally in combination with a binder agent, and (ii) a charge generation material 3 dispersed in the charge transport medium 4. In this embodiment, the aromatic polycarbonate resin (or a mixture of the aromatic polycarbonate resin and the binder agent) constitutes the charge transport medium 4. The charge generation material 3, which is, for example, an inorganic material or an organic pigment, generates charge carriers. The charge transport medium 4 accepts the charge carriers generated by the charge generation material 3 and transports those charge carriers.

In this electrophotographic photoconductor, it is basically necessary that the light-absorption wavelength regions of the charge generation material 3 and the aromatic polycarbonate resin not overlap in the visible light range. This is because, in order that the charge generation material 3 produce charge carriers efficiently, it is necessary that light pass through the charge transport medium 4 and reach the surface of the charge generation material 3. Since the aromatic polycarbonate resin comprising the repeat unit (I) do not substantially absorb light in the visible range, it can work effectively as a charge transport material when used with the charge generation material 3 which absorbs the light in the visible region and generates charge carriers. The charge transport medium 4 may further comprise a low-molecular weight charge transport material in combination.

Figure 3:
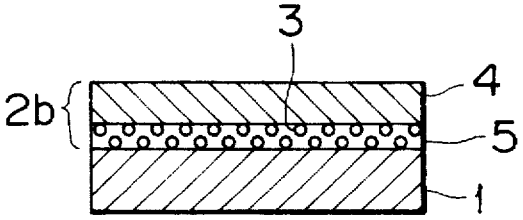
FIG. 3 is a schematic cross-sectional view of a third example of an electrophotographic photoconductor according to the present invention.

Referring to FIG. 3, there is shown an enlarged cross-sectional view of a further embodiment of an electrophotographic photoconductor according to the present invention. In the figure, there is formed on an electroconductive support 1 a two-layered photoconductive layer 2b comprising a charge generation layer 5 containing the charge generation material 3, and a charge transport layer 4 comprising an aromatic polycarbonate resin of the present invention.

In this photoconductor, light which has passed through the charge transport layer 4 reaches the charge generation layer 5, and charge carriers are generated within the charge generation layer 5. The charge carriers which are necessary for the light decay for latent electrostatic image formation are generated by the charge generation material 3, and accepted and transported by the charge transport layer 4. The generation and transportation of the charge carriers are performed by the same mechanism as that in the photoconductor shorn in FIG. 2.

In this case, the charge transport layer 4 comprises the aromatic polycarbonate resin, optionally in combination with a binder agent. Furthermore, in order to increase the efficiency of generating the charge carriers, the charge generation layer 5 may further comprise the aromatic polycarbonate resin of the present invention, and the photoconductive layer 2b including the charge generation layer 5 and the charge transport layer 4 may further comprise a low-molecular weight charge transport material. This can be applied to the embodiments of FIGS. 4 to 6 to be described later.

Figure 4:
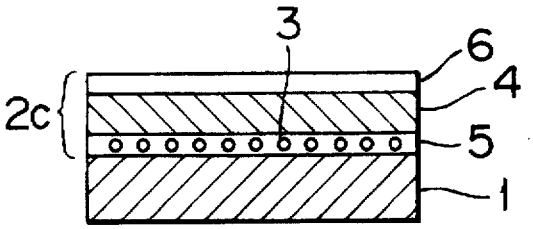
FIG. 4 is a schematic cross-sectional view of a fourth example of an electrophotographic photoconductor according to the present invention.

In the electrophotographic photoconductor of FIG. 3, a protective layer 6 may be provided on the charge transport layer 4 as shown in FIG. 4. The protective layer 6 may comprise the aromatic polycarbonate resin of the present invention, optionally in combination with a binder agent. In such a case, it is effective that the protective layer 6 be provided on a charge transport layer in which a low-molecular weight charge transport material id disposed. The protective layer 6 may be provided on the photoconductive layer 2a of photoconductor as shown in FIG. 2.

Figure 5:
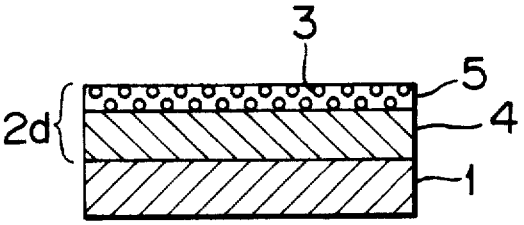
FIG. 5 is a schematic cross-sectional view of a fifth example of an electrophotographic photoconductor according to the present invention.

Referring to FIG. 5, there is shown still another embodiment of an electrophotographic photoconductor according to the present invention. In this figure, the overlaying order of the charge generation layer 5 and the charge transport layer 4 comprising the aromatic polycarbonate resin is reversed in view of the electrophotographic photoconductor an shown in FIG. 3. The mechanism of the generation and transportation of charge carriers is substantially the same as that of the photoconductor shown in FIG. 3.

Figure 6:
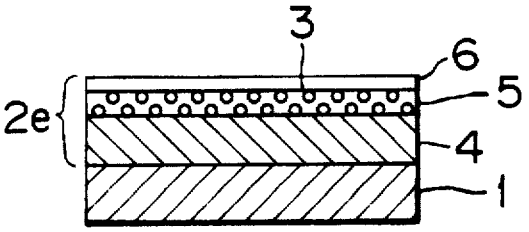
FIG. 6 is a schematic cross-sectional view of a sixth example of an electrophotographic photoconductor according to the present invention.

In the above photoconductor of FIG. 5, a protective layer 6 may be formed on the charge generation layer 5 as shown in FIG. 6 in light of the mechanical strength of the photoconductor.

When the electrophotographic photoconductor according to the present invention as shown in FIG. 1 is prepared, at least one aromatic polycarbonate resin of the present invention is dissolved in a solvent, with the addition thereto of a binder agent when necessary. To the thus prepared solution, a sensitizing dye is added, so that a photoconductive layer coating liquid is prepared. The thus prepared photoconductive layer coating liquid is coated on an electroconductive support 1 and dried, so that a photoconductive layer 2 is formed on the electroconductive support 1.

It is preferable that the thickness of the photoconductive layer 2 be in the range of 3 to 50 μm, more preferably in the range of 5 to 20 μm. It is preferable that the amount of the aromatic polycarbonate resin of the present invention be in the range of 30 to 100 wt. % of the total weight of the photoconductive layer 2.

It is preferable that the amount of the sensitizing dye for use in the photoconductive layer 2 be in the range of 0.1 to 5 wt. %, more preferably in the range of 0.5 to 3 wt. % of the total weight of the photoconductive layer 2.

Specific examples of the sensitizing dye for use in the present invention are triarylmethane dyes such as Brilliant Green, Victoria Blue B, Methyl violet, Crystal Violet and Acid Violet 6B; xanthene dyes such as Rhodamine B, Rhodamine 6G, Rhodamine G Extra, Eosin S, Erythrosin, Rose Bengale and Fluoresceine; thiazine dyes such as Methylene Blue; and cyanine dyes such as cyanin.

The electrophotographic photoconductor shown in FIG. 2 can be obtained by the following method:

The finely-divided particles of the charge generation material 3 are dispersed in a solution in which at least one aromatic polycarbonate resin of the present invention, or a mixture of the aromatic polycarbonate resin and the binder agent is dissolved, so that a coating liquid for the photoconductive layer 2a is prepared. The coating liquid thus prepared is coated on the electroconductive support 1 and then dried, whereby the photoconductive layer 2a is provided on electroconductive support 1.

It is preferable that the thickness of the photoconductive layer 2a be in the range of 3 to 50 μm, more preferably in the range of 5 to 20 μm. It is preferable that the amount of the aromatic polycarbonate resin for use in the photoconductive layer 2a be in the range of 40 to less than 100 wt. % of the total weight of the photoconductive layer 2a.

It is preferable that the amount of the charge generation material 3 for use in the photoconductive layer 2a be in the range of 0.1 to 50 wt. % preferably in the range of 1 to 20 wt. % of the total weight of the photoconductive layer 2a.

Specific examples of the charge generation material 3 for use in the present invention are as follows: inorganic materials such as selenium, selenium—tellurium, cadmium sulfide, cadmium sulfide—selenium and α-silicone; and organic pigments such as an azo pigment, for example, C.I. Pigment Blue 25 (C.I. 21180), C.I. Pigment Red 41 (C.I. 21200), C.I. Acid Red 52 (C.I. 45100), C.I. Basic Red 3 (C.I. 45210), an azo pigment having a carbazole skeleton (Japanese Laid-Open Patent Application 53-95033), an azo pigment having a distyryl benzene skeleton (Japanese Laid-Open Patent Application 53-133445), an azo pigment having a triphenylamine skeleton (Japanese Laid-Open Patent Application 53-132347), an azo pigment having a dibenzothiophene skeleton (Japanese Laid-Open Patent Application 54-21728), an azo pigment having an oxadiazole skeleton (Japanese Laid-Open Patent Application 54-12742), an azo pigment having a fluorenone skeleton (Japanese Laid-Open Patent Application 54-22834), an azo pigment having a bisstilbene skeleton (Japanese Laid-Open Patent Application 54-17733), an azo pigment having a distyryl oxadiazole skeleton (Japanese Laid-Open Patent Application 54-2129), and an azo pigment having a distyryl carbazole skeleton (Japanese Laid-Open Patent Application. 54-14967); a phthalocyanine pigment such as C.I. Pigment Blue.16 (C.I. 74100); an indigo pigment such as C.I. Vat Brown 5 (C.I. 73410) and C.I. Vat Dye (C.I. 73030); and a perylene pigment such as Algol Scarlet B and Indanthrene Scarlet R (made by Bayer Co., Ltd.). These charge generation materials may be used alone or in combination.

The electrophotographic photoconductor shown in FIG. 3 can be obtained by the following method:

To provide the charge generation layer 5 on the electroconductive support 1, the charge generation material is vacuum-deposited on the electroconductive support 1. Alternatively, the finely-divided particles of the charge generation material 3 are dispersed in an appropriate solvent, together with the binder agent when necessary, so that a coating liquid for the charge generation layer 5 is prepared. The thus prepared coating liquid is coated on the electroconductive support 1 and dried, whereby the charge generation layer 5 is formed on the electroconductive support 1. The charge generation layer 5 may be subjected to surface treatment by buffing and adjustment of the thickness thereof if required. On the thus formed charge generation layer 5, a coating liquid in which at least one aromatic polycarbonate resin of the present invention, optionally in combination with a binder agent is dissolved is coated and dried, so that the charge transport layer 4 is formed on the charge generation layer 5. In the charge generation layer 5, the same charge generation materials as employed in the above-mentioned photoconductive layer 2a can be used.

The thickness of the charge generation layer 5 is 5 μm or less, preferably 2 μm or less. It is preferable that the thickness of the charge transport layer 4 be in the range of 3 to 50 μm, more preferably in the range of 5 to 20 μm.

When the charge generation layer 5 is provided on the electroconductive support 1 by coating the dispersion in which finely-divided particles of the charge generation material 3 are dispersed in an appropriate solvent, it is preferable that the amount of finely-divided particles of the charge generation material 3 for use in the charge generation layer 5 be, in the range of 10 to 100 wt. %, more preferably in the range. of about 50 to 100 wt. % of the total weight of the charge generation layer 5. It is preferable that the amount of the aromatic polycarbonate resin of the present invention for use in the charge transport layer 4 be in the range of 40 to 100 wt. % of the total weight of the charge transport layer 4.

The photoconductive layer 2*b* of the photoconductor shown in FIG. 3 may comprise a low-molecular-weight charge transporting material as previously mentioned.

Examples of the low-molecular-weight charge transporting material for use in the present invention are as follows: oxazole derivatives, oxadiazole derivatives (Japanese Laid-Open Patent Applications 52-13965 and 52-139066), imidazole derivatives, triphenylamine derivatives (Japanese Laid-Open Patent Application 3-285960), benzidine derivatives (Japanese Patent Publication 58-32372), α-phenylstilbene derivatives (Japanese Laid-Open Patent Application 57-73075), hydrazone derivatives (Japanese Laid-Open Patent Applications 55-154955, 55-156954, 55-52063, and 56-81850), triphenylmethane derivatives (Japanese Patent Publication 51-10983), anthracene derivatives (Japanese Laid-Open Patent Application 51-94829), styryl derivatives (Japanese Laid-Open Patent Applications 56-29245 and 58-198043), carbazole derivatives (Japanese Laid-Open Patent Application 58-58552), and pyrene derivatives (Japanese Laid-Open Patent Application 2-94812).

To prepare the photoconductor shown in FIG. 4, a coating liquid for the protective layer 6 is prepared by dissolving the aromatic polycarbonate resin of the present invention, optionally in combination with the binder agent, in a solvent, and the thus obtained coating liquid is coated on the charge transport layer 4 of the photoconductor shown in FIG. 3, and dried.

It is preferable that the thickness of the protective layer 6 be in the range of 0.15 to 10 μm. It is preferable that the amount of the aromatic polycarbonate resin of the present invention for use in the protective layer 6 be in the range of 40 to 100 wt. % of the total weight of the protective layer 6.

The electrophotographic photoconductor shown in FIG. 5 can be obtained by the following method:

The aromatic polycarbonate resin of the present invention, optionally in combination with the binder agent, is dissolved in a solvent to prepare a coating liquid for the charge transport layer 4. The thus prepared costing liquid is coated on the electroconductive support 1 and dried, whereby the charge transport layer 4 is provided on the electroconductive support 1. On the thus formed charge transport layer 4, a coating liquid prepared by dispersing the finely-divided particles of the charge generation material 3 in a solvent in which the binder agent may be dissolved when necessary, is coated by spray coating and dried, so that the charge generation layer 5 is provided on the charge transport layer 4. The amount ratios of the components contained in the charge generation layer 5 and charge transport layer 4 are the same as those previously described in FIG. 3.

The electrophotographic photoconductor shown in FIG. 6 can be fabricated by forming a protective layer 6 on the charge generation layer 5 of the photoconductor shown in. FIG. 5.

To obtain any of the aforementioned photoconductors of the present invention, a metallic plate or foil made of aluminum, a plastic film on which a metal such as aluminum is deposited, and a sheet of paper which has been treated so as to be electroconductive can be employed as the electroconductive support 1.

Specific examples of the binder agent used in the preparation of the photoconductor according to the present invention are condensation resins such as polyamide, polyurethane, polyester, epoxy resin, polyketone and polycarbonate; and vinyl polymers such as polyvinylketone, polystyrene, poly-N-vinylcarbazole and polyacrylamide. All the resins having insulating properties and adhesion properties can be employed.

Some plasticizers may be added to the abovementioned binder agents, when necessary. Examples of the plasticizer for use in the present invention are halogenated paraffin, dimethylnaphthalene and dibutyl phthalate. Further, a variety of additives such as an antioxidant, a light stabilizer, a thermal stabilizer and a lubricant may also be contained in the binder agents when necessary.

Furthermore, in the electrophotographic photoconductor according to the present invention, an intermediate layer such aa an adhesive layer or a barrier layer may be interposed between the electroconductive support and the photoconductive layer when necessary. Examples of the material for use in the intermediate layer are polyamide, nitrocellulose and aluminum oxide. It is preferable that the thickness of the intermediate layer be 1 μm or less.

When copying it performed by use of the photoconductor according to the present invention, the surface of the photoconductor is uniformly charged to a predetermined polarity in the dark. The uniformly charged photoconductor is exposed to a light image so that a latent electrostatic image is formed on the surface of the photoconductor. The thus formed latent electrostatic image is developed to a visible image by a developer, and the developed image can be transferred to a sheet of paper when necessary.

The photosensitivity end the durability of the electrophotographic photoconductor according to the present invention are remarkably improved.

Other features of this invention will become apparent in the course of the following description of exemplary embodiments, which are given for illustration of the invention and are not intended to be limiting thereof.

Preparation Example 1

90.0 g (0.232 mol) of 1,1-bis(4-methoxyphenyl)-4-(4-nitrophenyl)-1,3-butadiene was dissolved in 770 ml of N,N-dimethylformamide (hereinafter referred to as "DMF").

To this solution, 90.0 g of iron powder was added, and an aqueous solution of 22 ml of concentrated hydrochloric acid in 69 ml of water was then added dropwise. This mixture was stirred at 75° to 83° C. for 1 hour and then cooled to 50° C. To this mixture, 55 ml 20% aqueous solution of sodium hydroxide was added.

Insoluble components were filtered out, together with a filter aid, from the reaction mixture. The filtrate was concentrated and water was added thereto.

The mixture was then extracted with toluene. The extract was concentrated, so that 500 ml of a toluene solution was obtained.

To this toluene solution, 40 ml of acetic anhydride was added. The reaction mixture was refluxed for 30 minutes and diluted with n-hexane.

Crystals separated out in the mixture. The crystals were filtered off, end recrystallized from toluene, whereby 1,1-bis(4-methoxyphenyl)-4-(4-acetamidophenyl)-1,3-butadiene was obtained in the former pale yellow needles in a yield of 79.1 g (85.2%).

Melting point: 183.0° to 183.5° C.

| Elemental analysis: | | | |
|---|---|---|---|
| | % C | % H | % N |
| Found | 78.45 | 6.34 | 3.40 |
| Calcd. | 79.16 | 6.32 | 3.51 |

Figure 8:
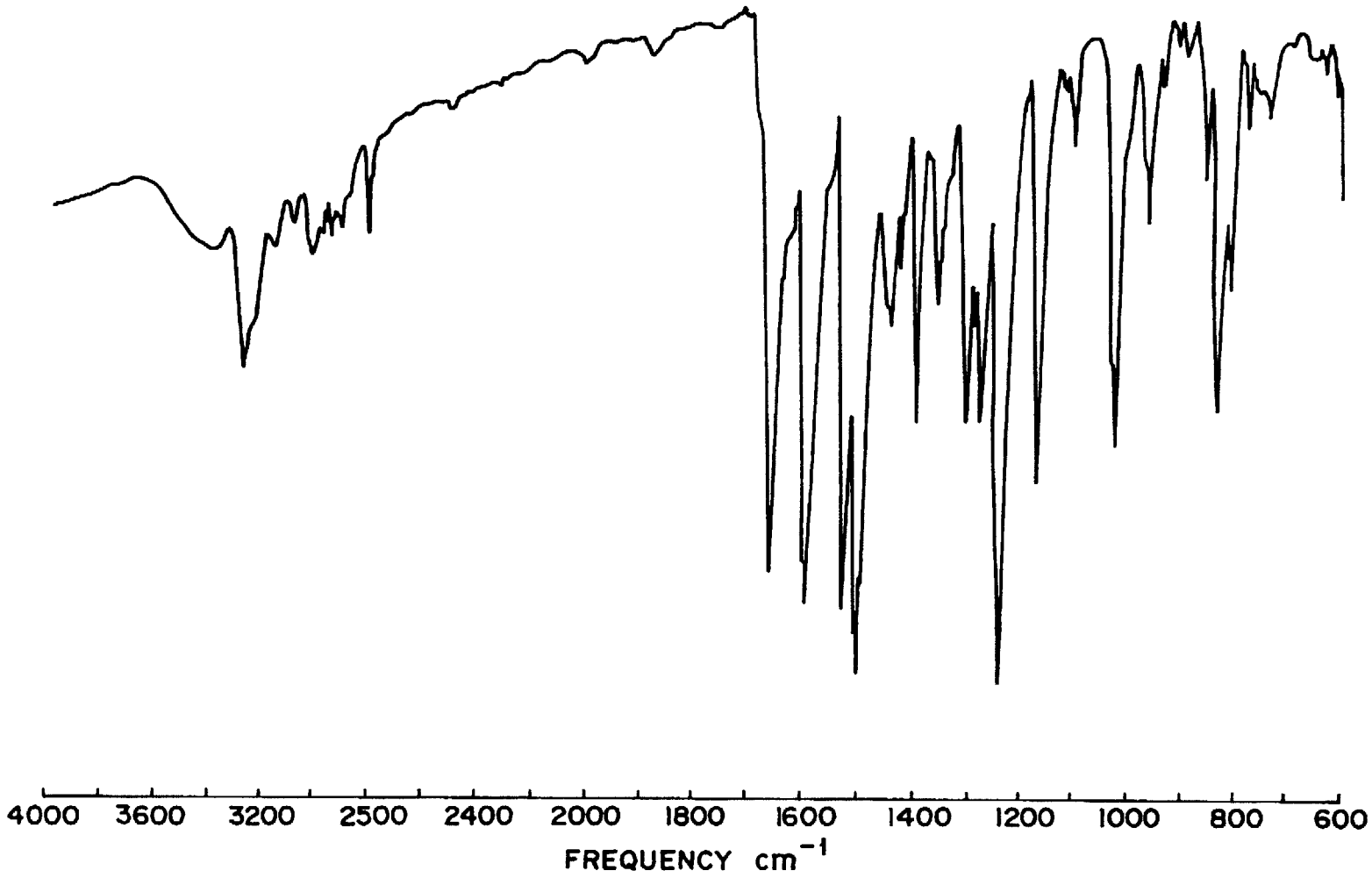
FIG. 8 is an IR spectrum of 1,1-bis(4-methoxyphenyl)-4-(4-acetamidophenyl)-1,3-butadiene obtained in Preparation Example 1.

An infrared spectrum of his product, taken by use of a KBr tablet, is shown in FIG. 8.

| | |
|---|---|
| νNH: 3280 $cm^{-1}$ | νC=O: 1660 $cm^{-1}$ |
| νCOC: 1250 and 1030 $cm^{-1}$ | |
| δ trans-olefin: 970 $cm^{-1}$ | |

Preparation Example 2

300 ml of p-bromotoluene, 54.8 g (0.396 mol) of potassium carbonate end 3.44 g of copper powder were added to 79.1 g (0.198 mol) of 1,1-bis(4-methoxyphenyl)-4-(4-acetamidophenyl)-1,3-butadiene obtained in Preparation Example 1.

In a stream of nitrogen, this mixture was refluxed for 18 hours with azeotropic elimination of water therefrom. The reaction mixture was cooled to room temperature, and toluene was added thereto.

Insoluble components were filtered out, together with a filter aid, from the reaction mixture. The filtrate was concentrated, and the residue was then chromatographed on silica gel and eluted with a mixed solvent of toluene and ethyl acetate (2:1), whereby 104.0 g of an orange oil was obtained.

The thus obtained orange of was dissolved in 300 ml of isoamyl alcohol. To his solution, an aqueous solution of 27.6 g of potassium hydroxide in 90 ml of water was added.

The reaction mixture was refluxed for 4 hours, with water being removed therefrom. The reaction mixture was then cooled to room temperature. Crystals separated out In the mixture. The crystals were filtered off, and washed with methanol and water, whereby yellow crystals were obtained.

The thus obtained yellow crystals were recrystallized from a mixed solvent of toluene and n-hexane, whereby 1,1-bis(4-methoxyphenyl)-4-[4-(p-tolylamino)phenyl]-1,3-butadiene was obtained in the form of yellow needles in a yield of 75.0 g (85.4%).

Melting point: 127.5° to 128.5° C.

| Elemental analysis: | | | |
|---|---|---|---|
| | % C | % H | % N |
| Found | 83.31 | 6.68 | 3.05 |
| Calcd. | 83.18 | 6.54 | 3.13 |

Figure 9:
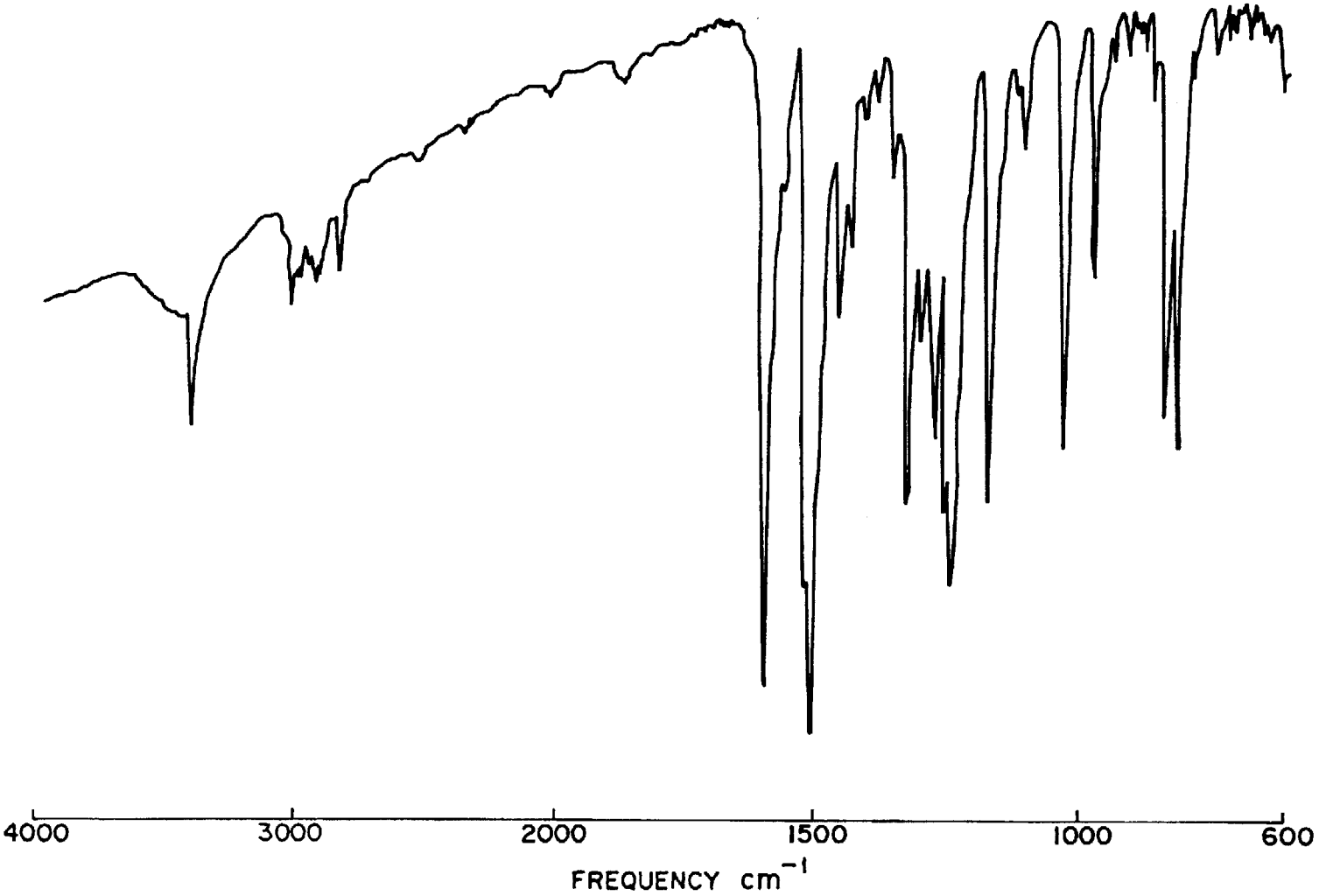
FIG. 9 is an IR spectrum of 1,1-bis(4-methoxyphenyl)-4-[4-(p-tolylamino)phenyl]-1,3-butadiene obtained in Preparation Example 2.

An infrared spectrum of this product, taken by use of a KBr tablet, is shown in FIG. 9.

νNH: 3400 $cm^{-1}$

νCOC: 1240 and 1030 $cm^{-1}$

δtrans-olefin: 975 $cm^{-1}$

Preparation Example 3

44.8 g (0.100 mol) of 1,1-bis(4-methoxyphenyl)-4-[4-(p-tolylamino)phenyl]-1,3-butadiene obtained in Preparation Example 2, 87.2 g (0.400 mol) of p-iodotoluene, 55.3 g (0.400 mol) of potassium carbonate, 3.43 g of copper powder and 140 ml of nitrobenzene were placed in a reaction vessel.

In a stream of nitrogen, this reaction mixture was refluxed for 6 hours with azeotropic elimination of water therefrom. This mixture was cooled to room temperature.

Insoluble components were filtered out, together with a filter aid, from the reaction mixture. The filtrate was concentrated, to that a dark red oil was obtained.

The thus obtained dark red oil was chromatographed on silica gel and eluted with a mixed solvent of toluene and n-hexane (1:1), whereby a reaction product was obtained.

The thus obtained product was recrystallized from a mixed solvent of toluene and ethanol, whereby 1,1-bis(4-methoxyphenyl)-4-[4-(di-p-tolylamino)phenyl]-1,3-butadiene was obtained in the form of yellow needles in a yield of 38.7 g (71.9%).

Melting point: 133.0° to 135.0° C.

| Elemental analysis: | | | |
|---|---|---|---|
| | % C | % H | % N |
| Found | 84.96 | 6.72 | 2.49 |
| Calcd. | 84.87 | 6.57 | 2.61 |

Figure 10:
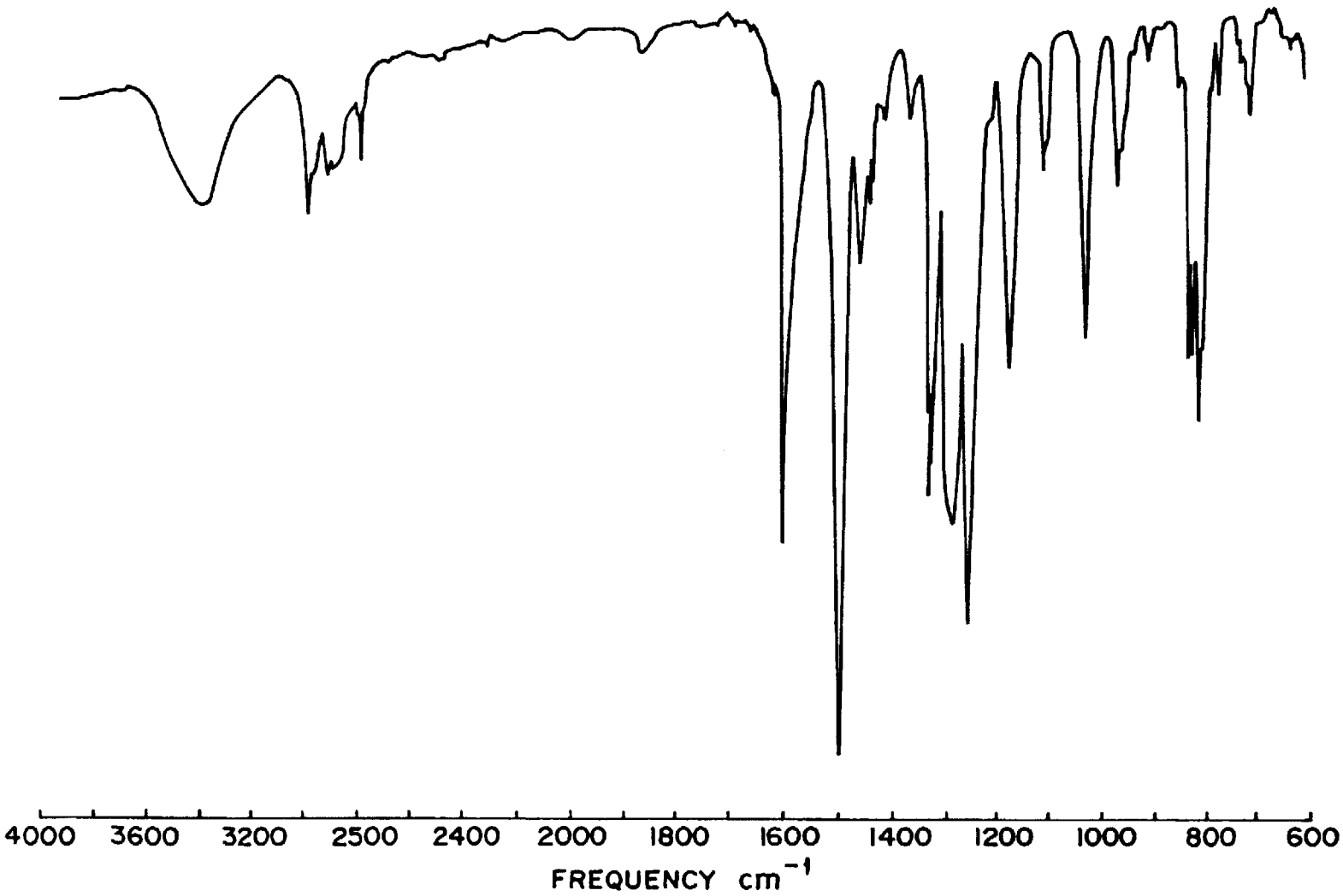
FIG. 10 is an IR spectrum of 1,1-bis(4-methoxyphenyl)-4-[4-(di-p-tolylamino)phenyl]-1,3-butadiene obtained in Preparation Example 3.

An infrared spectrum of this product, taken by use of a KBr tablet, is shown in FIG. 10.

νCOC: 1245 and 1035 $cm^{-1}$

δtrans-olefin: 970 $cm^{-1}$

Preparation Example 4

32.7 g (0.061 mol) of 1,1-bis(4-methoxyphenyl)-4-[4-(di-p-tolylamino)phenyl]1,3-butadiene obtained in Preparation Example 3 and 20.4 g (0.243 mol) of 90% sodium thioethylate were dissolved in 200 ml of dried DMF.

This mixture was refluxed for 9 hours and then cooled to room temperature. The reaction mixture was then poured into iced water. To this mixture, concentrated hydrochloric acid was added, so that the mixture was neutralized.

This reaction mixture was extracted with ethyl acetate. The extracted layer was washed with water, and then dried. The solvent was distilled away from extracted layer.

The residue was chromatographed on silica gel and eluted with a mixed solvent of toluene and ethyl acetate (4:1), whereby 31.0 g of yellow powder was obtained. The thus obtained yellow powder was recrystallized from ethanol. Crystals separated out in the mixture. The crystals were filtered off and dried, with application of heat thereto under reduced pressure, whereby 1,1-bis(4-hydroxyphenyl)-4-[4-(di-p-tolylamino)phenyl]-1,3-butadiene was obtained in the form of yellow prisms in a yield of 25.4 g (81.9%).

Melting point: 252.5° to 254.5° C.

| Elemental analysis: | | | |
|---|---|---|---|
| | % C | % H | % N |
| Found | 85.04 | 6.04 | 3.04 |
| Calcd. | 84.83 | 6.14 | 2.75 |

Figure 11:
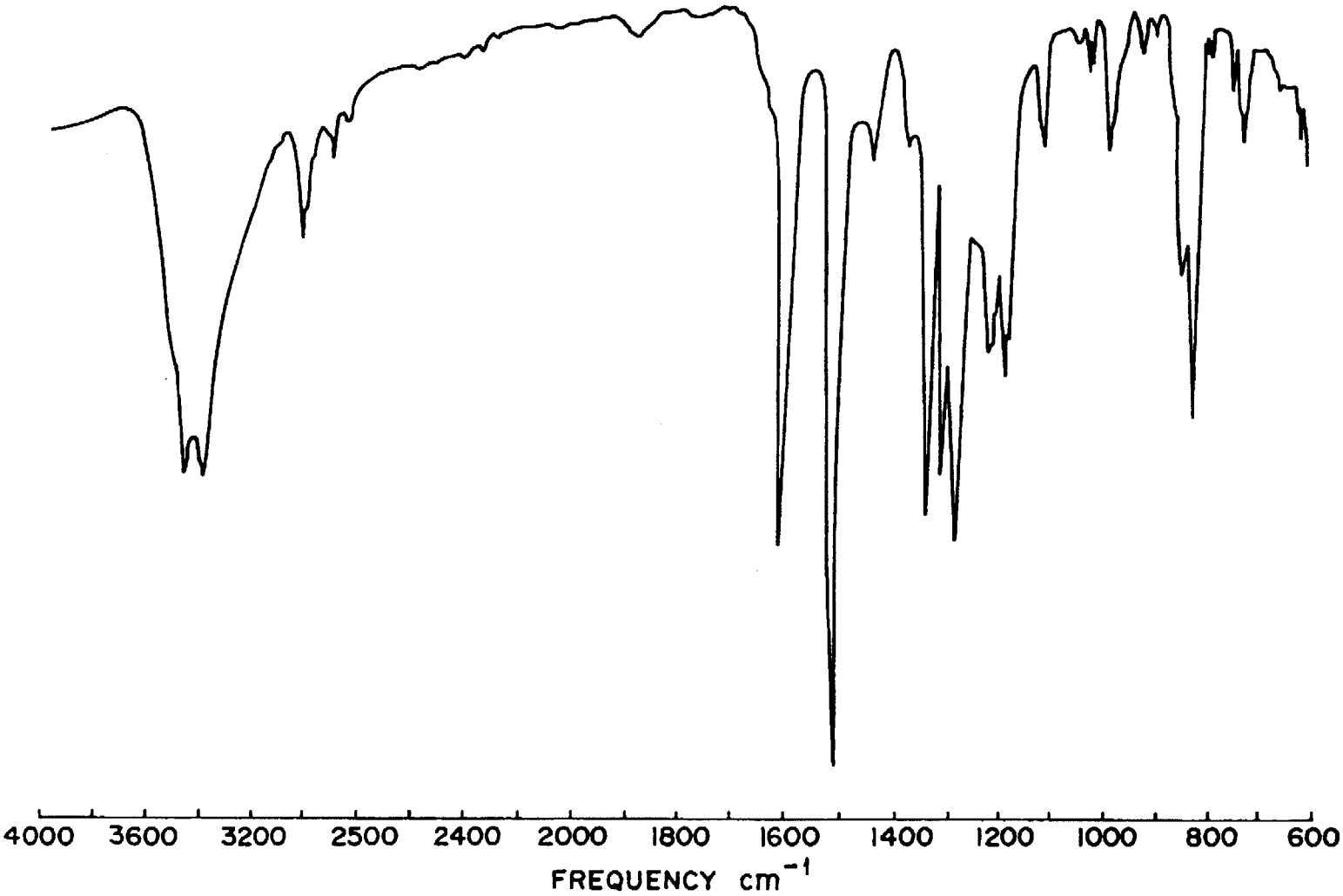
FIG. 11 is an IR spectrum of 1,1-bis(4-hydroxyphenyl)-4-[4-(di-p-tolylamino)phenyl]-1,3-butadiene obtained in Preparation Example 4.

An infrared spectrum of this product, taken by use of a KBr tablet, is shown in FIG. 11.

νCOC: 3470 and 3400 $cm^{-1}$

δtrans-olefin: 980 $cm^{-1}$

Preparation Example 5

26.4 g (0.052 mol) of 1,1-bis(4-hydroxyphenyl)-4-[4-(di-p-tolylamino)phenyl]-1,3-butadiene obtained in Preparation Example 4 was dissolved in 150 ml of dried pyridine.

To this solution, 12.3 g (0.156 mol) of acetyl chloride was added dropwise at 21° to 25° C. over a period of 1 hour on a water bath. The reaction mixture was stirred at room temperature for 6 hours, and then poured over ice. Concentrated hydrochloric acid was added to the mixture.

The reaction mixture was extracted with ethyl acetate. The extracted layer was washed with water and dried. The solvent was distilled away from the extracted layer.

The residue was chromatographed on silica gel and eluted with toluene, whereby a reaction product was obtained, the thus obtained product was then recrystallized from a mixed solvent of ethyl acetate and ethanol, whereby 1,1-bis(4-acetoxyphenyl)-4-[4-(di-p-tolylamino)phenyl]-1,3-butadiene was obtained in the form of yellow needles in a yield of 24.7 g (80.0%).

Melting point: 159.5° to 160.5° C.

| | Elemental analysis: | | |
|---|---|---|---|
| | % C | % H | % N |
| Found | 81.09 | 5.96 | 2.12 |
| Calcd. | 80.91 | 5.95 | 2.36 |

Figure 12:
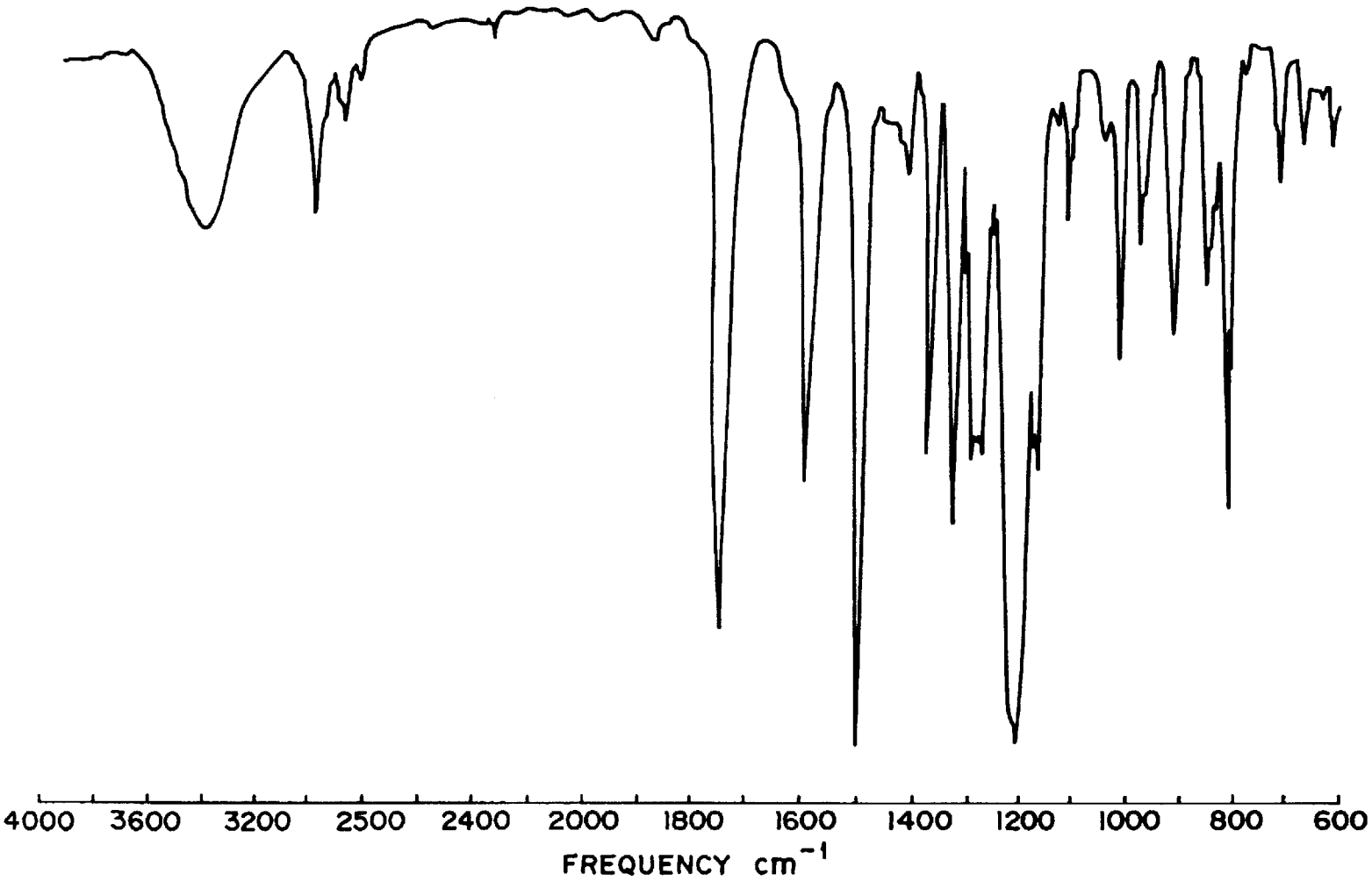
FIG. 12 is an IR spectrum of 1,1-bis(4-acetoxyphenyl)-4-[4-(di-p-tolylamino)phenyl]-1,3-butadiene obtained in Preparation Example 5.

An infrared spectrum of this product, taken by use of a KBr tablet, is shown in FIG. 12.

νC=O: 1760 $cm^{-1}$

δtrans-olefin: 975 $cm^{-1}$

Preparation Examples 6 to 9

The procedure of Preparation Example 3 was repeated except that the p-iodotoluene employed in Preparation Example 3 was replaced by the respective aryl halides as shown in Table 1, whereby conjugated diene compounds Nos. 6 to 9 as shown in Table 1 were respectively obtained in Preparation Examples 6 to 9.

The results of elemental analysis and the melting points of the diene compounds Nos. 6 to 9 are also shown in Table 1.

Figure 13:
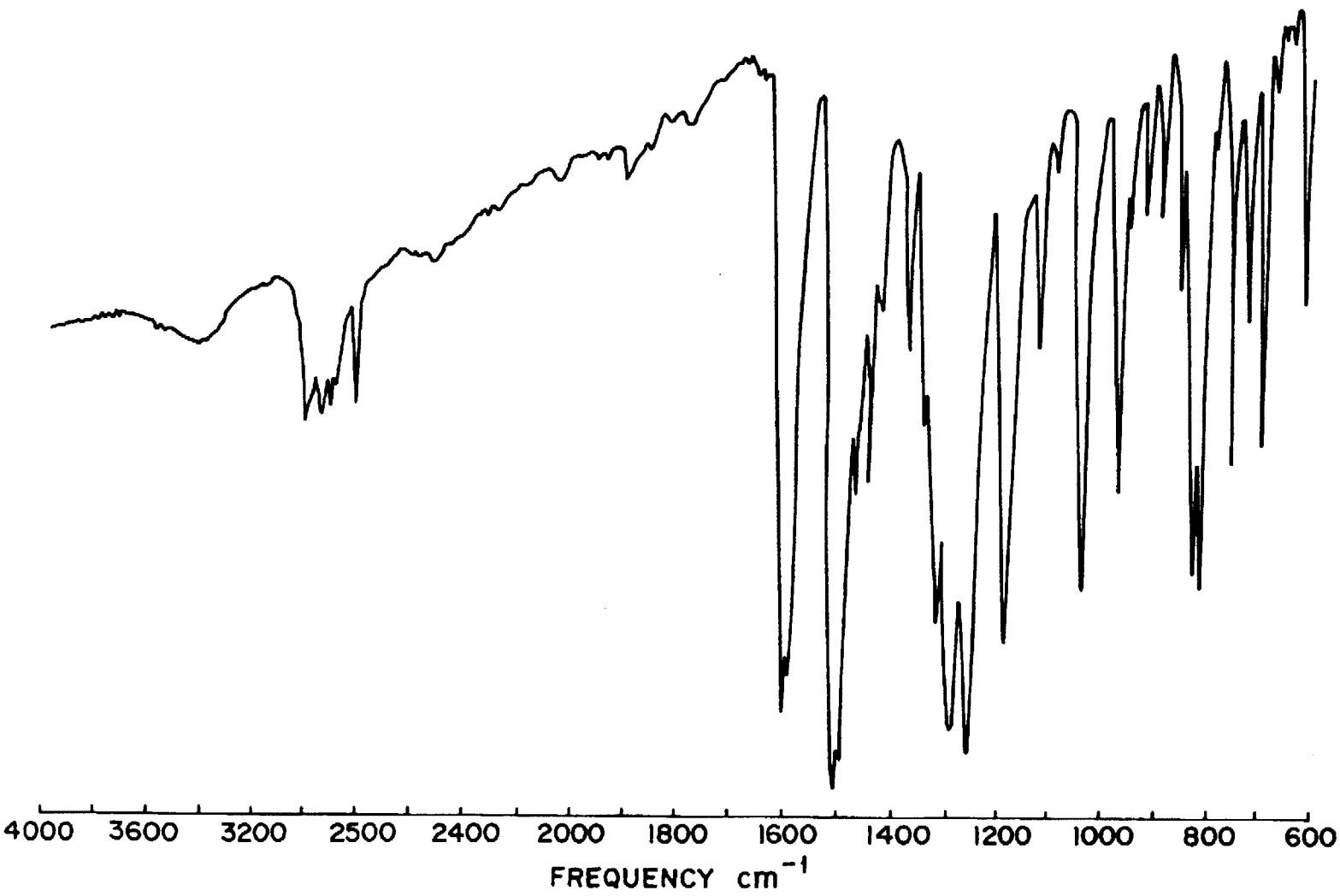
FIG. 13 is an IR spectrum of 1,1-bis(4-methoxyphenyl)-4-[4-(p-tolylamino)phenyl]-1,3-butadiene obtained in Preparation Example 9.

Furthermore, an infrared spectrum of 1,1-bis(4-methoxyphenyl)-4-[4-(p-tolylamino)phenyl]-1,3-butadiene obtained in Preparation Example 9, taken by use of a KBr tablet, is shown in FIG. 13.

TABLE 1
| Preparation Ex. No. | Aryl Halide | Conjugated Diene Compound | Melting Point (°C.) | Elemental Analysis % C Found (Calcd.) | % H Found (Calcd.) | % N Found (Calcd.) |
|---|---|---|---|---|---|---|
| 6 | 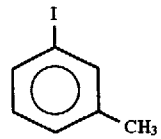 | [No. 6] 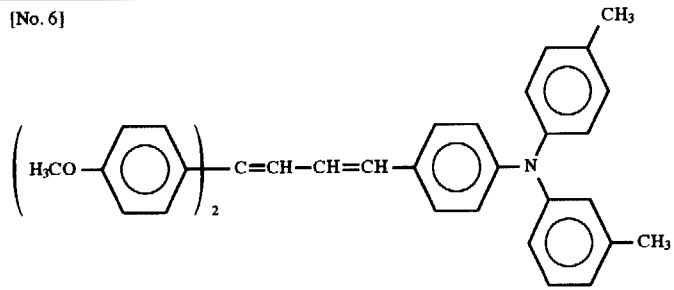 | 134.5~136.5 | 85.14 (84.87) | 6.60 (6.57) | 2.40 (2.61) |
| 7 | 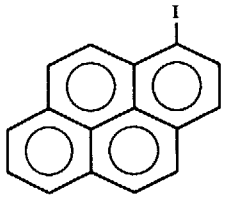 | [No. 7] 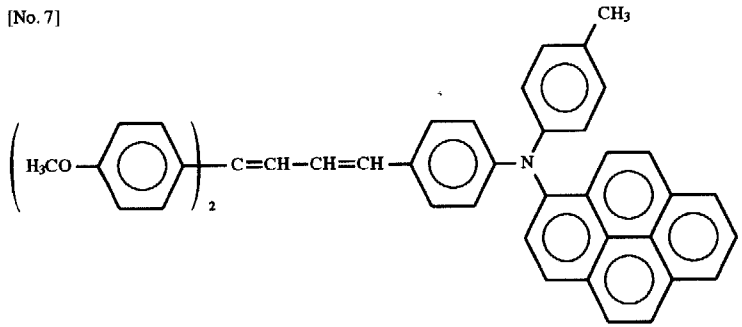 | 176.5~180.5 | 87.05 (87.13) | 5.77 (5.77) | 2.25 (2.16) |

TABLE 1-continued
| Preparation Ex. No. | Aryl Halide | Conjugated Diene Compound | Melting Point (°C.) | Elemental Analysis % C Found (Calcd.) | % H Found (Calcd.) | % N Found (Calcd.) |
|---|---|---|---|---|---|---|
| 8 | 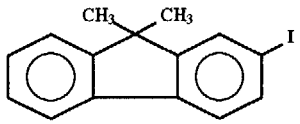 | [No. 8] 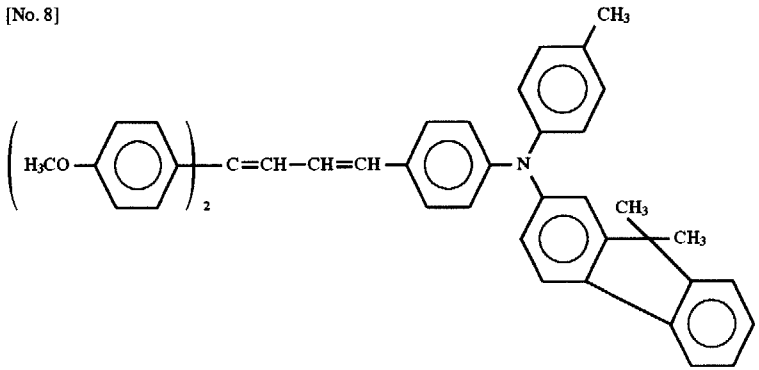 | Amorphous substance | 85.99 (86.34) | 6.42 (6.47) | 1.90 (2.19) |
| 9 | 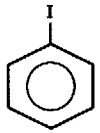 | [No. 9] 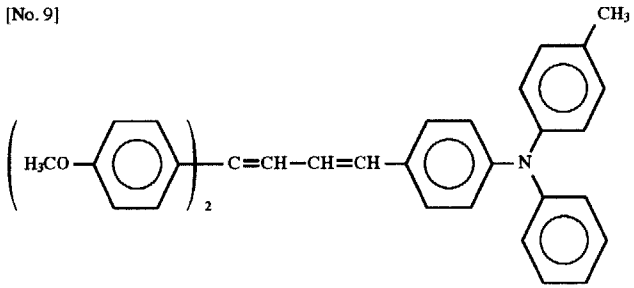 | 154.5~156.0 | 85.28 (84.86) | 6.42 (6.35) | 2.61 (2.67) |

Preparation Examples 10 to 12

The conjugated diene compounds obtained in Examples 6, 8 and 9 were subjected to demethylation in accordance with the procedure conducted in Preparation Example 4, whereby corresponding diene compounds Nos. 10, 11 and 12 shown in Table 2 wets respectively obtained, provided that with respect to diene compound No. 12, acetylation was conducted after the above-mentioned demethylation.

The results of the elemental analyses and the melting points of the diene compounds Nos. 10, 11 and 12 are also shown in Table 2.

TABLE 2
| Preparation Ex. No. | Conjugated Diene Compound | Melting Point (°C.) | Elemental Analysis % C Found (Calcd.) | % Found (Calcd.) | % N Found (Calcd.) |
|---|---|---|---|---|---|
| 10 | [No. 10] 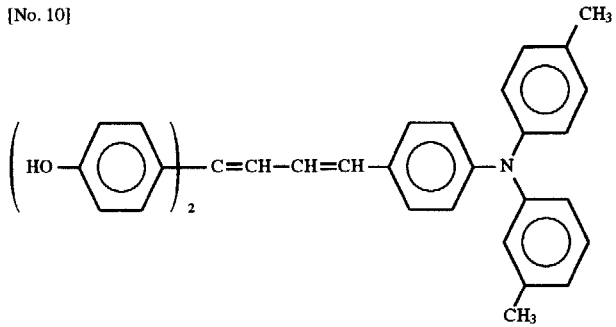 | 89.9 (endothermic peak) | 85.30 (85.59) | 6.62 (6.46) | 2.31 (2.42) |
| 11 | [No. 11] 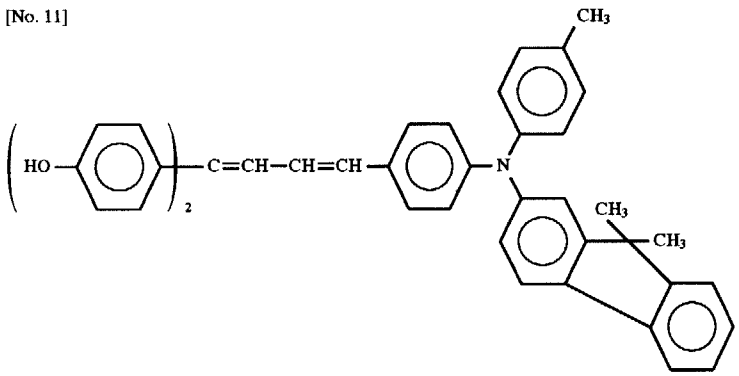 | Amorphous substance | 86.32 (86.32) | 6.87 (6.69) | 2.13 (2.13) |

TABLE 2-continued
| Preparation Ex. No. | Conjugated Diene Compound | Melting Point (°C.) | Elemental Analysis % C Found (Calcd.) | % Found (Calcd.) | % N Found (Calcd.) |
|---|---|---|---|---|---|
| 12 | [No. 12] 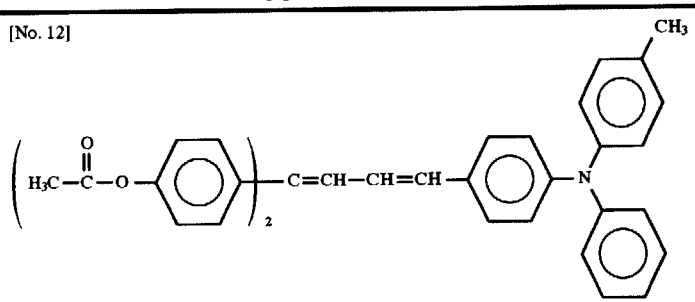 | 154.5~155.5 | 80.99 (80.81) | 5.69 (5.74) | 2.41 (2.42) |

EXAMPLE 1-1

[Synthesis of aromatic polycarbonate resin (Compound No. 1)]

In a stream of nitrogen, 2.55 g (5.0 mmol) of 1,1-bis(4-hydroxyphenyl)-4-[4-(di-p-tolylamino)phenyl]-1,3-butadiene obtained in Preparation Example 4 and 1.52 g (15.0 mmol) of triethylamine were dissolved in 20 ml of dry tetrahydrofuran to prepare a solution (a). A solution (b) prepared dissolving 1.16 g (5.0 mmol) of diethylene glycol bis(chloroformate) in 4 ml of dry tetrahydrofuran was added dropwise to the solution (a) at 23.0° to 28.0° C. over a period of 30 minutes.

Subsequently, the above obtained reaction mixture was stirred an room temperature for 30 minutes, and then 0.48 g of a 4% tetrahydrofuran solution containing phenol was added to the reaction mixture, followed by stirring for 10 minutes at room temperature.

Thereafter, triethylamine hydrochloride which separated out was removed from the reaction mixture by filtration, and the resultant filtrate was added dropwise to methanol.

Then, the precipitated resin was filtered off. The obtained resin was purified by repeating the process of dissolving the resin in tetrahydrofuran and precipitating it in methanol twice. The resin thus purified was dried under reduced pressure, so that 3.01 g of an aromatic polycarbonate resin (Compound No. 1) according to the present invention having a repeat unit of the following formula (A) was obtained in the form of yellow powder. The yield was 90.1%.

(A)

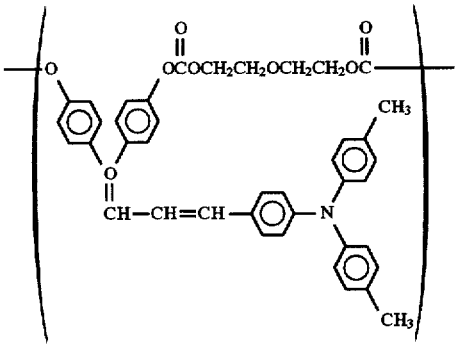

The glass transition temperature (Tg) of the thus obtained aromatic polycarbonate resin was 121.1° C. The polystyrene-reduced number-average molecular weight and weight-average molecular weight, which were measured by the gel permeation chromatography, were respectively 9,000 and 17,200.

The results of the elemental analysis of the thus obtained compound are shown in Table 5. The calculation is based on the formula for $C_{42}H_{37}NO_7$.

Figure 7:
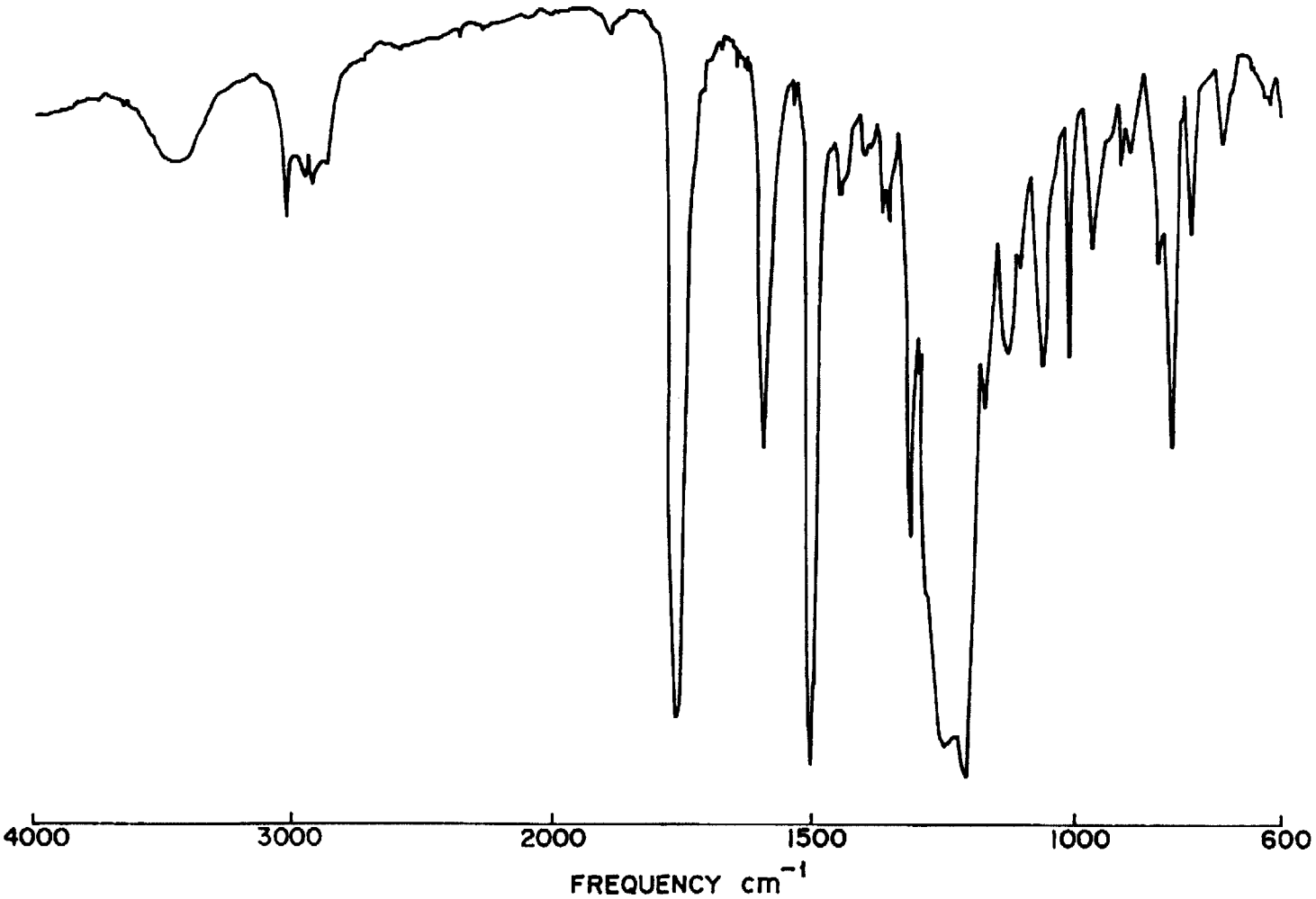
FIG. 7 is an IR spectrum of an aromatic polycarbonate resin synthesized in Example 1-1 according to the present invention, taken by use of a KBr tablet.

FIG. 7 shows an infrared spectrum of the aromatic polycarbonate resin (compound No. 1), taken by use of KBr tablet.

The IR spectrum indicates the appearance of the characteristic absorption peak due to C=O stretching vibration of carbonate at 1760 $cm^{-1}$; and the characteristic absorption peak due to out-of-plane deformation vibration of trans-olefin at 970 $cm^{-1}$.

EXAMPLES 1-2 to 1-4

[Synthesis of aromatic polycarbonate resins (Compound No. 2 to No. 4) shown in Table 3]

The procedure for preparation of the aromatic polycarbonate resin (Compound No. 1) in Example 1-1 was repeated except that diethylene glycol bis(chloroformate) used in example 1-1 was replaced by the respective bis (chloroformate) compounds as shown in Table 3.

Thus, aromatic polycarbonate resins (Compound No. 2 to Compound No. 4) according to the present invention were obtained, each having a repeat unit as shown in Table 3.

The glass transition temperature (Tg), the polystyrene-reduced number-average molecular weight (Mn), the polystyrene-reduced weight-average molecular weight (Mw), and the results of the elemental analysis of each of the obtained aromatic polycarbonate resins are shown in Table 5.

The infrared spectra of the aromatic polycarbonate resins (Compound No. 2 to Compound No. 4) obtained in Examples 1-2 to 1-4, taken by use of a KBr tablet, indicate the appearance of the characteristic absorption peaks as follows:

| | |
|---|---|
| [Compound No. 2] | νC=O: 1760 $cm^{-1}$<br>δtrans-olefin: 970 $cm^{-1}$ |
| [Compound No. 3] | νC=O: 1780 $cm^{-1}$<br>δtrans-olefin: 970 $cm^{-1}$ |
| [Compound No. 4] | νC=O: 1760 $cm^{-1}$<br>δtrans-olefin: 970 $cm^{-1}$ |

TABLE 3

| Example No. | Bis(chloroformate) | Aromatic Polycarbonate Resin |
|---|---|---|
| 1-2 | $ClCO(CH_2)_6OCCl$ | [Compound No. 2] |
| 1-3 | | [Compound No. 3] |
| 1-4 | $ClCO(CH_2CH_2CH_2CH_2O)_{3.09}CCl$ | [Compound No. 4] |

EXAMPLES 1-5 to 1-8

[Synthesis of aromatic polycarbonate resins (Compound No. 5 to No. 8) shown in Table 4]

The procedure for preparation of the aromatic polycarbonate resin (Compound No. 1) in Example 1-1 was repeated except that diethylene glycol bis(chloroformate) and 1,1-bis(4-hydroxyphenyl)-4-[4-(di-p-tolylamino) phenyl]-1,3-butadiene used in Example 1-1 were replaced by respective bis(chloroformate) compounds and diols as shown in Table 4.

Thus, aromatic polycarbonate resins (Compound No. 5 to Compound No. 8) according to the present invention were obtained, each having a repeat unit as shown in Table 4.

The glass transition temperature (Tg), the polystyrene-reduced number-average molecular weight (Mn), the polystyrene-reduced weight-average molecular weight (Mw), and the results of the elemental analysis of each of the obtained aromatic polycarbonate resins are shown in Table 5.

TABLE 4
| Example No. | Diol | Bis(chloroformate) | Aromatic Polycarbonate Resin |
|---|---|---|---|
| 1-5 | 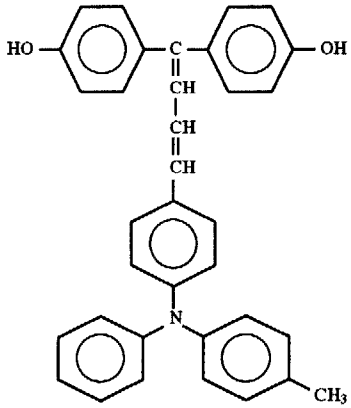 | 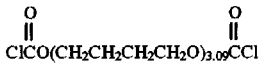 | [Compound No. 5] 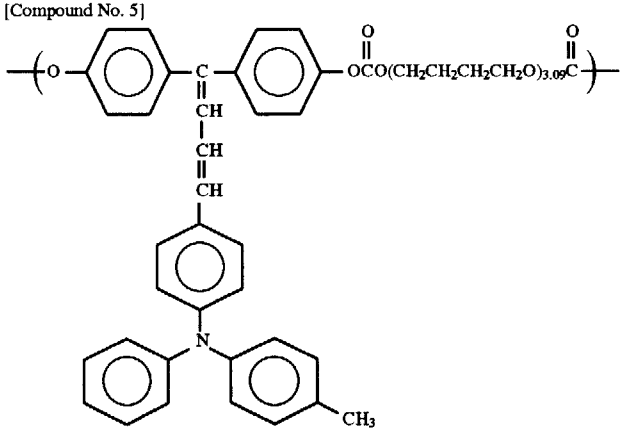 |
| 1-6 | | 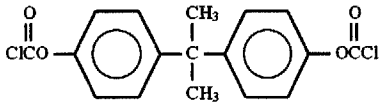 | [Compound No. 6] 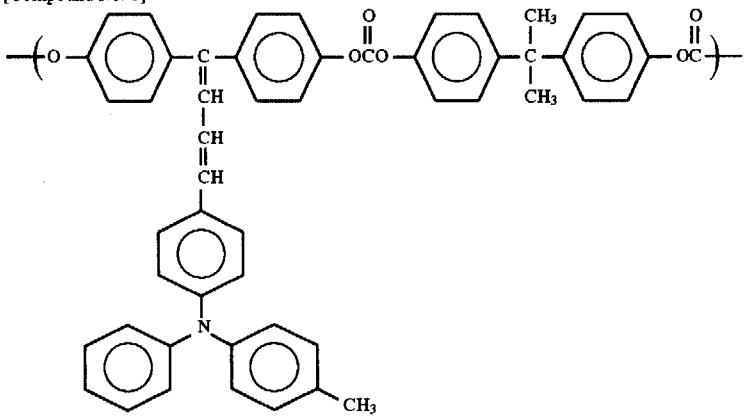 |

TABLE 4-continued
| Example No. | Diol | Bis(chloroformate) | Aromatic Polycarbonate Resin |
|---|---|---|---|
| 1-7 | 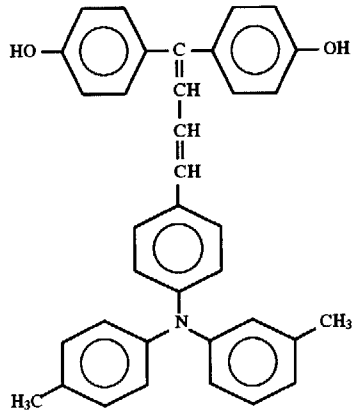 | 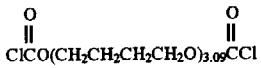 | [Compound No. 7] 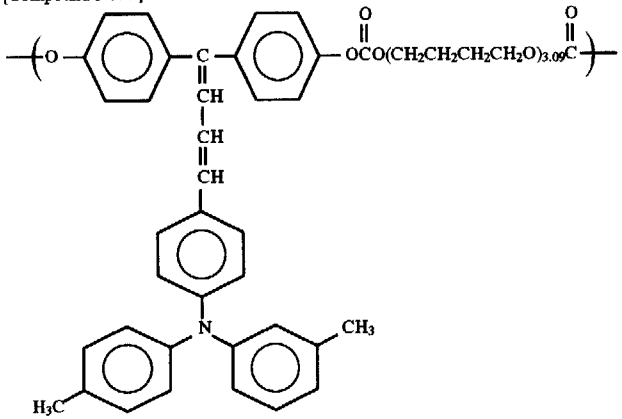 |
| 1-8 | 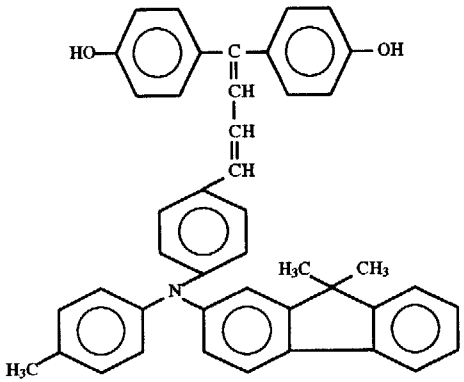 | 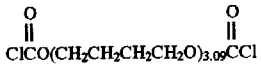 | [Compound No. 8] 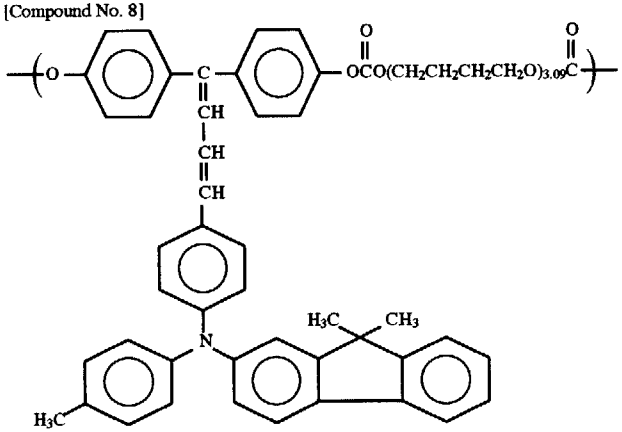 |

TABLE 5

| Example No. | Tg (°C.) | Molecular Weight(*) Mn × $10^{-4}$ | Mw × $10^{-4}$ | Elemental Analysis % C Found (Calcd.) | % H Found (Calcd.) | % N Found (Calcd.) |
|---|---|---|---|---|---|---|
| 1-1 | 121.1 | 0.90 | 1.72 | 75.68 (75.53) | 5.67 (5.60) | 2.18 (2.10) |
| 1-2 | 119.7 | 0.92 | 1.63 | 78.07 (77.73) | 6.14 (6.09) | 2.18 (2.06) |
| 1-3 | 166.3 | 0.71 | 1.63 | 80.68 (80.58) | 5.57 (5.50) | 1.87 (1.77) |
| 1-4 | 70.3 | 2.54 | 7.94 | 75.41 (75.36) | 6.94 (6.76) | 1.86 (1.75) |
| 1-5 | 56.4 | 1.32 | 3.98 | 74.66 (74.72) | 5.23 (7.21) | 1.82 (1.77) |
| 1-6 | 173.9 | 0.84 | 2.04 | 80.61 (80.50) | 5.31 (5.33) | 1.79 (1.81) |
| 1-7 | 60.8 | 2.49 | 7.61 | 74.86 (75.36) | 6.80 (6.76) | 1.75 (1.75) |
| 1-8 | 85.4 | 2.00 | 5.97 | 76.93 (77.48) | 6.68 (6.67) | 1.58 (1.55) |

(*)The molecular weight is expressed by a polyutyrene-reduced value.

EXAMPLE 2-1

[Fabrication of Photoconductor No. 1]

(Formation of intermediate layer)

A commercially available polyamide resin (Trademark "CM-8000", made by Toray Industries, Inc.) was dissolved in a mixed solvent of methanol and butanol, so that a coating liquid for an intermediate layer was prepared.

The thus prepared coating liquid was coated on an aluminum plate by a doctor blade, and dried at room temperature, so that an intermediate layer with a thickness of 0.3 μm was provided on the aluminum plate.

(Formation of charge generation layer)

A coating liquid for a charge generation layer was prepared by dispersing a bisazo compound of the following formula, serving as a charge generation material, in a mixed solvent of cyclohexanone and methyl ethyl ketone in a ball mill. The thus obtained coating liquid was coated on the above prepared intermediate layer by a doctor blade, and dried at room temperature. Thus, a charge generation layer with a thickness of about 1 μm was formed on the intermediate layer.

[Formation of charge transport layer]

The aromatic polycarbonate resin (Compound No. 1) of the present invention prepared in Example 1-1, which served as a charge transport material, was dissolved in dichloromethane. The thus obtained coating liquid was coated on the above prepared charge generation layer by a doctor blade, and dried at room temperature and then at 120° C. for 20 minutes, so that a charge transport layer with a thickness of about 20 μm was provided on the charge generation layer.

Thus, an electrophotographic photoconductor No. 1 according to the present invention was fabricated.

EXAMPLES 2-2 to 2-8

The procedure for fabrication of the layered electrophotographic photoconductor No. 1 in Example 2-1 was repeated except that the aromatic polycarbonate resin (Compound No. 1) for use in the charge transport layer coating liquid in Example 2-1 was replaced by each of the aromatic polycarbonate resins (Compounds No. 2 to No. 8 illustrated in Tables 3 and 4) as shown in Table 6.

Thus, electrophotographic photoconductors No. 2 to No. 8 according to the present invention were fabricated.

Each of the electrophotographic photoconductors No. 1 through No. 8 according to the present invention obtained in Examples 2-1 to 2-8 was charged negatively in the dark under application of −6 kV of corona charge for 20 seconds, using a commercially available electrostatic copying sheet testing apparatus ("Paper Analyzer Model SP-428" made by Kawaguchi Electro Works Co., Ltd.). Then, each electrophotographic photoconductor was allowed to stand in the dark for 20 seconds without applying any charge thereto, and the surface potential Vo (V) of the photoconductor was measured. Each photoconductor was then illuminated by a tungsten lamp in such a manner that the luminance on the illuminated surface of the photoconductor was 4.5 lux, and the exposure $E_{1/2}$ (lux.sec) required to reduce the initial surface potential Vo (V) to ½ the initial surface potential vo (V) was measured. The results are shown in Table 6.

TABLE 6

| Example No. | Aromatic Polycarbonate Resin (Compound No.) | −Vo (V) | $E_{1/2}$ (lux · sec) |
|---|---|---|---|
| 2-1 | No. 1 | 785 | 0.86 |
| 2-2 | No. 2 | 615 | 0.76 |
| 2-3 | No. 3 | 425 | 1.10 |
| 2-4 | No. 4 | 634 | 0.80 |
| 2-5 | No. 5 | 1030 | 0.95 |
| 2-6 | No. 6 | 1413 | 1.29 |

[Bisazo compound]

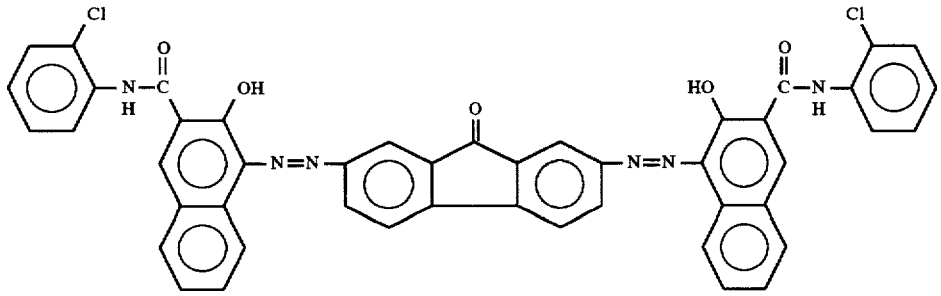

TABLE 6-continued

| Example No. | Aromatic Polycarbonate Resin (Compound No.) | −Vo (V) | $E_{1/2}$ (lux · sec) |
|---|---|---|---|
| 2-7 | No. 7 | 848 | 0.78 |
| 2-9 | No. 8 | 889 | 0.72 |

Furthermore, each of the above obtained electrophotographic photoconductors No. 1 to No. 8 was set in a commercially available electrophotographic copying machine, and the photoconductor was charged and exposed to light images via the original images to form latent electrostatic images thereon. Then, the latent electrostatic images formed on the photoconductor were developed into visible toner images by a dry developer, and the visible toner images were transferred to a sheet of plain paper and fixed thereon. As a result, clear toner images were obtained on the paper. When a wet developer was employed for the image formation, clear images were formed on the paper similarly.

As previously explained, the photoconductive layer of the electrophotographic photoconductor according to the present invention comprises an aromatic polycarbonate resin having a repeat unit with a tertiary amine structure, which is represented by formula (I), or an aromatic polycarbonate resin having a repeat unit with a tertiary amine structure, represented by formula (II) and a repeat unit of formula (III). The above-mentioned aromatic polycarbonate resins have charge transporting properties and high mechanical strength, so that the photosensitivity and durability of the photoconductor are sufficiently high.

Japanese Patent Application No. 07-141290 filed May 16, 1995, Japanese Patent Application No. 07-176189 filed Jul. 12, 1995, Japanese Patent Application No. 07-177402 filed Jul. 13, 1995, Japanese Patent Application No. 07-336739 filed Dec. 25, 1995, and Japanese Patent Applications filed May 15, 1996 and May 16, 1996 are hereby incorporated by reference.

What is claimed is:

1. An electrophotographic photoconductor comprising an electroconductive support, and a photoconductive layer formed thereon comprising as an effective component an aromatic polycarbonate resin having a repeat unit of formula (I):

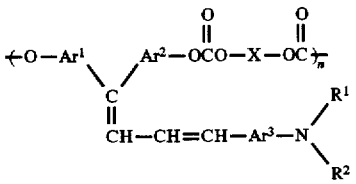

(I)

wherein n is an integer of 5 to 5000; $Ar^1$, $Ar^2$ and $Ar^3$ each may be the same or different, and is a bivalent aromatic hydrocarbon group; $R^1$ and $R^2$ each may be the same or different, and is an acyl group, an alkyl group which may have a substituent, an aromatic hydrocarbon group which may have a substituent, or a heterocyclic group which may have a substituent; and X is a bivalent aliphatic group, a bivalent cyclic aliphatic group, or

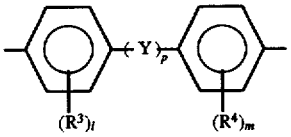

in which $R^3$ and $R^4$ each is an alkyl group which may have a substituent, an aromatic hydrocarbon group which may have a substituent, or a halogen atom; l and m each is an integer of 0 to 4; and p is an integer of 0 or 1, and when p=1, Y is a straight-chain, branched or cyclic alkylene group having 1 to 12 carbon atoms, —O—, —S—, —SO—, —$SO_2$—,

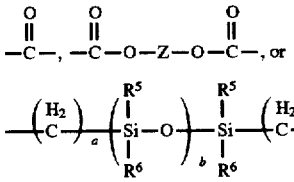

in which Z is a bivalent aliphatic hydrocarbon group; a is an integer of 0 to 20; b is an integer of 1 to 2000; and $R^5$ and $R^6$ each is an alkyl group which may have a substituent or an aromatic hydrocarbon group which may have a substituent.

2. The electrophotographic photoconductor as claimed in claim 1, wherein said acyl group represented by $R^1$ and $R^2$ is selected from the group consisting of acetyl group, propionyl group, and benzoyl group.

3. The electrophotographic photoconductor as claimed in claim 1, wherein said alkyl group represented and $R^1$ and $R^2$ is a straight-chain or branched alkyl group having 1 to 5 carbon atoms.

4. The electrophotographic photoconductor as claimed in claim 1, wherein said substituent of said alkyl group represented by $R^1$ and $R^2$ is selected from the group consisting of a fluorine atom, cyano group, and a phenyl group which may have a substituent selected from the group consisting of a halogen atom and an alkyl group having 1 to 5 carbon atoms.

5. The electrophotographic photoconductor as claimed in claim 1, wherein said aromatic hydrocarbon group represented by $R^1$ and $R^2$ is selected from the group consisting of phenyl group, a fused polycyclic group, and a non-fused polycyclic group.

6. The electrophotographic photoconductor as claimed in claim 5, wherein said fused polycyclic group is selected from the group consisting of naphthyl group, pyrenyl group, 2-fluorenyl group, 9,9-dimethyl-2-fluorenyl group, azulenyl group, anthryl group, triphenylenyl group, chrysenyl group, fluorenylidenephenyl group, and 5H-dibenzo[a,d] cycloheptenylidenephenyl group.

7. The electrophotographic photoconductor as claimed in claim 5, wherein said non-fused polycyclic group is selected from the group consisting of biphenylyl group, terphenylyl group and a group of formula (IX):

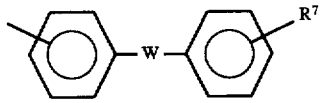

(IX)

wherein $R^7$ is selected from the group consisting of a halogen atom, a substituted or unsubstituted alkyl group having 1 to 12 carbon atoms, a substituted or unsubstituted alkoxyl group having 1 to 12 carbon atoms, a substituted or unsubstituted aryloxy group, a substituted mercapto group, an arylmercapto group, an alkylenedioxy group, an alkylenedithio group, and a group of

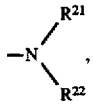

in which $R^{21}$ and $R^{22}$ each is an alkyl group or an aryl group; and W is selected from the group consisting of —O—, —S—, —SO—, —$SO_2$—, —CO—, and bivalent groups:

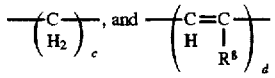

in which c is an integer of 1 to 12; d is an integer of 1 to 3; and $R^8$ is a hydrogen atom, a substituted or unsubstituted alkyl group, or a substituted or unsubstituted aromatic hydrocarbon group.

8. The electrophotographic photoconductor as claimed in claim 1, wherein said substituent of said aromatic hydrocarbon group represented by $R^1$ and $R^2$ is selected from the group consisting of a halogen atom, a substituted or unsubstituted alkyl group having 1 to 12 carbon atoms, a substituted or unsubstituted alkoxyl group having 1 to 12 carbon atoms, a substituted or unsubstituted aryloxy group, a substituted mercapto group, a arylmercapto group, an alkylenedioxy group, an alkylenedithio group, and a group of

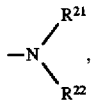

in which $R^{21}$ and $R^{22}$ each is an alkyl group or an aryl group.

9. The electrophotographic photoconductor as claimed in claim 1, wherein said heterocyclic group represented by $R^1$ and $R^2$ is selected from the group consisting of thienyl group, benzothienyl group, furyl group, benzofuranyl group, and carbazolyl group.

10. The electrophotographic photoconductor as claimed in claim 1, wherein said substituent of said heterocyclic group represented by $R^1$ and $R^2$ is selected from the group consisting of a halogen atom, a substituted or unsubstituted alkyl group having 1 to 12 carbon atoms, a substituted or unsubstituted alkoxyl group having 1 to 12 carbon atoms, a substituted or unsubstituted aryloxy group, a substituted mercapto group, an arylmercapto group, an alkylenedioxy group, an alkylenedithio group, and a group of

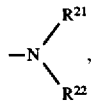

in which $R^{21}$ and $R^{22}$ each is an alkyl group or an aryl group.

11. The electrophotographic photoconductor as claimed in claim 1, wherein said bivalent aromatic hydrocarbon group represented by $Ar^1$, $Ar^2$ and $Ar^3$ is phenylene group.

12. An electrophotographic photoconductor comprising an electroconductive support, and a photoconductive layer formed thereon comprising as an effective component an aromatic polycarbonate resin having a repeat unit of formula (II) and a repeat unit of formula (III), with the composition ratio of said repeat unit of formula (II) to said repeat unit of formula (III) being in the relationship of $0<k/(k+j)\leqq 1$:

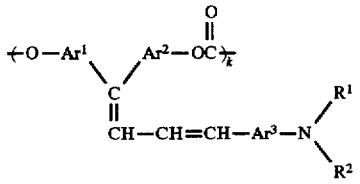

(II)

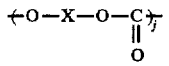

(III)

wherein k is an integer of 5 to 5000; j is an integer of 0 to 5000; $Ar^1$, $Ar^2$ and $Ar^3$ each may be the same or different, and is a bivalent aromatic hydrocarbon group; $R^1$ and $R^2$ each may be the same or different, and is an acyl group, an alkyl group which may have a substituent, an aromatic hydrocarbon group which may have a substituent, or a heterocyclic group which may have a substituent; and X is a bivalent aliphatic group, a bivalent cyclic aliphatic group, or

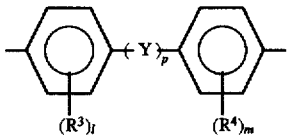

in which $R^3$ and $R^4$ each is an alkyl group which may have a substituent, an aromatic hydrocarbon group which may have a substituent, or a halogen atom; l and m each is an integer of 0 to 4; and p is an integer of 0 or 1, and when p=1, Y is a straight-chain, branched or cyclic alkylene group having 1 to 12 carbon atoms, —O—, —S—, —SO—, —$SO_2$—,

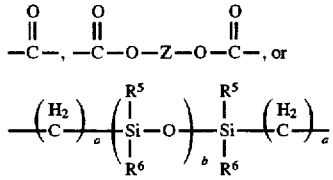

in which Z is a bivalent aliphatic hydrocarbon group; a is an integer of 0 to 20; b is an integer of 1 to 2000; and $R^5$ and $R^6$ each is an alkyl group which may have a substituent or an aromatic hydrocarbon group which may have a substituent.

13. The electrophotographic photoconductor as claimed in claim 12, wherein said acyl group represented by $R^1$ and $R^2$ is selected from the group consisting of acetyl group, propionyl group, and benzoyl group.

14. The electrophotographic photoconductor as claimed in claim 12, wherein said alkyl group represented by $R^1$ and $R^2$ is a straight-chain or branched alkyl group having 1 to 5 carbon atoms.

15. The electrophotographic photoconductor as claimed in claim 12, wherein said substituent of said alkyl group represented by $R^1$ and $R^2$ is selected from the group consisting of a fluorine atom, cyano group, and a phenyl group which may have a substituent selected from the group consisting of a halogen atom and an alkyl group having 1 to 5 carbon atoms.

16. The electrophotographic photoconductor as claimed in claim 12, wherein said aromatic hydrocarbon group represented by $R^1$ and $R^2$ is selected from the group consisting of phenyl group, a fused polycyclic group, and a non-fused polycyclic group.

17. The electrophotographic photoconductor as claimed in claim 16, wherein said fused polycyclic group is selected from the group consisting of naphthyl group, pyrenyl group, 2-fluorenyl group, 9,9-dimethyl-2-fluorenyl group, azulenyl group, anthryl group, triphenylenyl group, chrysenyl group, fluorenylidenephenyl group, and 5H-dibenzo[a,d] cycloheptenylidenephenyl group.

18. The electrophotographic photoconductor as claimed in claim 16, wherein said non-fused polycyclic group is selected from the group consisting of biphenylyl group, terphenylyl group and a group of formula (IX):

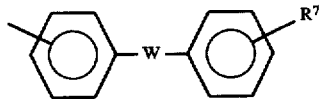

(IX)

wherein $R^7$ is selected from the group consisting of a halogen atom, a substituted or unsubstituted alkyl group having 1 to 12 carbon atoms, a substituted or unsubstituted alkoxyl group having 1 to 12 carbon atoms, a substituted or unsubstituted aryloxy group, a substituted mercapto group, an arylmercapto group, an alkylenedioxy group, an alkylenedithio group, and a group of

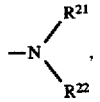

in which $R^{21}$ and $R^{22}$ each is an alkyl group or an aryl group; and W is selected from the group consisting of —O—, —S—, —SO—, —$SO_2$—, —CO—, and bivalent groups:

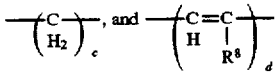

in which c is an integer of 1 to 12; d is an integer of 1 to 3; and $R^0$ is a hydrogen atom, a substituted or unsubstituted alkyl group, or a substituted or unsubstituted aromatic hydrocarbon group.

19. The electrophotographic photoconductor as claimed in claim 12, wherein said substituent of said aromatic hydrocarbon group represented by $R^1$ and $R^2$ is selected from the group consisting of a halogen atom, a substituted or unsubstituted alkyl group having 1 to 12 carbon atoms, a substituted or unsubstituted alkoxyl group having 1 to 12 carbon atoms, a substituted or unsubstituted aryloxy group, a substituted mercapto group, an arylmercapto group, an alkylenedioxy group, an alkylenedithio group, and a group of

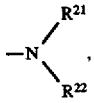

in which $R^{21}$ and $R^{22}$ each is an alkyl group or an aryl group.

20. The electrophotographic photoconductor as claimed in claim 12, wherein said heterocyclic group represented by $R^1$ and $R^2$ is selected from the group consisting of thienyl group, benzothienyl group, furyl group, benzofuranyl group, and carbazolyl group.

21. The electrophotographic photoconductor as claimed in claim 12, wherein said substituent of said heterocyclic group represented by $R^1$ and $R^2$ is selected from the group consisting of a halogen atom, a substituted or unsubstituted alkyl group having 1 to 12 carbon atoms, a substituted or unsubstituted alkoxyl group having 1 to 12 carbon atoms, a substituted or unsubstituted aryloxy group, a substituted mercapto group, an arylmercapto group, an alkylenedioxy group, an alkylenedithio group, and a group of

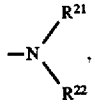

in which $R^{21}$ and $R^{22}$ each is an alkyl group or an aryl group.

22. The electrophotographic photoconductor as claimed in claim 12, wherein said bivalent aromatic hydrocarbon group represented by $Ar^1$, $Ar^2$ and $Ar^3$ is phenylene group.

23. An aromatic polycarbonate resin having a repeat unit of formula (I):

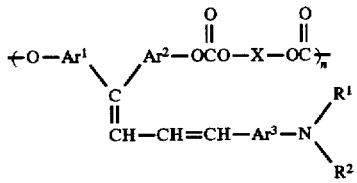

(I)

wherein n is an integer of 5 to 5000; $Ar^1$, $Ar^2$ and $Ar^3$ each may be the same or different, and is a bivalent aromatic hydrocarbon group; $R^1$ and $R^2$ each may be the same or different, and is an acyl group, an alkyl group which may have a substituent, an aromatic hydrocarbon group which may have a substituent, or a heterocyclic group which may have a substituent; and X is a bivalent aliphatic group, a bivalent cyclic aliphatic group, or

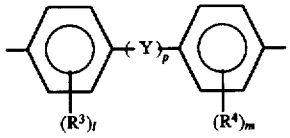

in which $R^3$ and $R^4$ each is an alkyl group which may have a substituent, an aromatic hydrocarbon group which may have a substituent, or a halogen atom; l and m each is an integer of 0 to 4; and p is an integer of 0 or 1, and when p=1, Y is a straight-chain, branched or cyclic alkylene group having 1 to 12 carbon atoms, —O—, —S—, —SO—, —$SO_2$—,

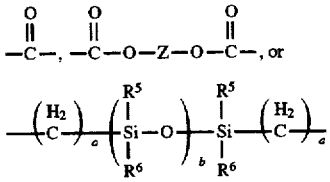

in which Z is a bivalent aliphatic hydrocarbon group; a is an integer of 0 to 20; b is an integer of 1 to 2000; and $R^5$ and $R^6$ each is an alkyl group which may have a substituent or an aromatic hydrocarbon group which may have a substituent.

24. The aromatic polycarbonate resin as claimed in claim 23, wherein said acyl group represented by $R^1$ and $R^2$ is selected from the group consisting of acetyl group, propionyl group, and benzoyl group.

25. The aromatic polycarbonate resin as claimed in claim 23, wherein said alkyl group represented by $R^1$ and $R^2$ is a straight-chain or branched alkyl group having 1 to 5 carbon atoms.

26. The aromatic polycarbonate resin as claimed in claim 23, wherein said substituent of said alkyl group represented by $R^1$ and $R^2$ is selected from the group consisting of a fluorine atom, cyano group, and a phenyl group which may have a substituent selected from the group consisting of a halogen atom and an alkyl group having 1 to 5 carbon atoms.

27. The aromatic polycarbonate resin as claimed in claim 23, wherein said aromatic hydrocarbon group represented by $R^1$ and $R^2$ is selected from the group consisting of phenyl group, a fused polycyclic group, and a non-fused polycyclic group.

28. The aromatic polycarbonate resin as claimed in claim 27, wherein said fused polycyclic group is selected from the group consisting of naphthyl group, pyrenyl group, 2-fluorenyl group, 9,9-dimethyl-2-fluorenyl group, azulenyl group, anthryl group, triphenylenyl group, chrysenyl group, fluorenylidenephenyl group, and 5H-dibenzo[a,d]cyclo-heptenylidenephenyl group.

29. The aromatic polycarbonate resin as claimed in claim 27, wherein said non-fused polycyclic group is selected from the group consisting of biphenylyl group, terphenylyl group and a group of formula (IX):

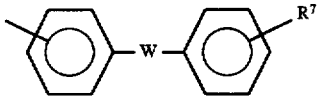

(IX)

wherein $R^7$ is selected from the group consisting of a halogen atom, a substituted or unsubstituted alkyl group having 1 to 12 carbon atoms, a substituted or unsubstituted alkoxyl group having 1 to 12 carbon atoms, a substituted or unsubstituted aryloxy group, a substituted mercapto group, an arylmercapto group, an alkylenedioxy group, an alkylenedithio group, and a group of

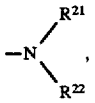

in which $R^{21}$ and $R^{22}$ each is an alkyl group or an aryl group; and W is selected from the group consisting of —O—, —S—, —SO—, —$SO_2$—, —CO—, and bivalent groups:

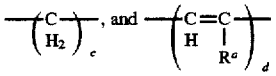

in which c is an integer of 1 to 12; d is an integer of 1 to 3; and $R^8$ is a hydrogen atom, a substituted or unsubstituted alkyl group, or a substituted or unsubstituted atomatic hydrocarbon group.

30. The aromatic polycarbonate resin as claimed in claim 23, wherein said substituent of said aromatic hydrocarbon group represented by $R^1$ and $R^2$ is selected from the group consisting of a halogen atom, a substituted or unsubstituted alkyl group having 1 to 12 carbon atoms, a substituted or unsubstituted alkoxyl group having 1 to 12 carbon atoms, a substituted or unsubstituted aryloxy group, a substituted mercapto group, an arylmercapto group, an alkylenedioxy group, an alkylenedithio group, and a group of

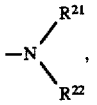

in which $R^{21}$ and $R^{22}$ each is an alkyl group or an aryl group.

31. The aromatic polycarbonate resin as claimed in claim 23, wherein said heterocyclic group represented by $R^1$ and $R^2$ is selected from the group consisting of thienyl group, benzothienyl group, furyl group, benzofuranyl group, and carbazolyl group.

32. The aromatic polycarbonate resin as claimed in claim 23, wherein said substituent of said heterocyclic group represented by $R^1$ and $R^2$ is selected from the group consisting of a halogen atom, a substituted or unsubstituted alkyl group having 1 to 12 carbon atoms, a substituted or unsubstituted alkoxyl group having 1 to 12 carbon atoms, a substituted or unsubstituted aryloxy group, a substituted mercapto group, an arylmercapto group, an alkylenedioxy group, an alkylenedithio group, and a group of

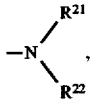

in which $R^{21}$ and $R^{22}$ each is an alkyl group or an aryl group.

33. The aromatic polycarbonate resin as claimed in claim 23, wherein said bivalent aromatic hydrocarbon group represented by $Ar^1$, $Ar^2$ and $Ar^3$ is phenylene group.

34. An aromatic polycarbonate resin having a repeat unit of formula (II) and a repeat unit of formula (III), with the composition ratio of said repeat unit of formula (II) to said repeat unit of formula (III) being in the relationship of $0<k/(k+j)\leqq 1$:

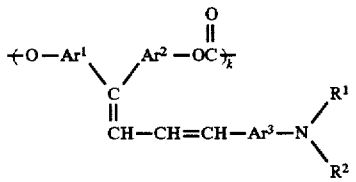

(II)

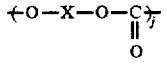

(III)

wherein k is an integer of 5 to 5000; j is an integer of 0 to 5000; $Ar^1$, $Ar^2$ and $Ar^3$ each may be the same or different, and is a bivalent aromatic hydrocarbon group; $R^1$ and $R^2$ each may be the same or different, and is an acyl group, an alkyl group which may have a substituent, an aromatic hydrocarbon group which may have a substituent, or a heterocyclic group which may have a substituent; and X is a bivalent aliphatic group, a bivalent cyclic aliphatic group, or

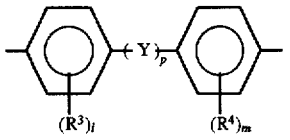

in which $R^3$ and $R^4$ each is an alkyl group which may have a substituent, an aromatic hydrocarbon group which may have a substituent, or a halogen atom; l and m each is an integer of 0 to 4; and p is an integer of 0 or 1, and when p=1, Y is a straight-chain, branched or cyclic alkylene group having 1 to 12 carbon atoms, —O—, —S—, —SO—, —$SO_2$—,

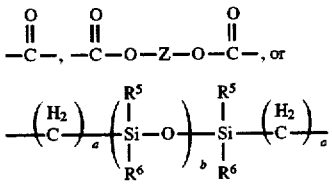

in which Z is a bivalent aliphatic hydrocarbon group; a is an integer of 0 to 20; b is an integer of 1 to 2000; and $R^5$ and $R^6$ each is an alkyl group which may have a substituent or an aromatic hydrocarbon group which may have a substituent.

35. The aromatic polycarbonate resin as claimed in claim 34, wherein said acyl group represented by $R^1$ and $R^2$ is selected from the group consisting of acetyl group, propionyl group, and benzoyl group.

36. The aromatic polycarbonate resin as claimed in claim 34, wherein said alkyl group represented by $R^1$ and $R^2$ is a straight-chain or branched alkyl group having 1 to 5 carbon atoms.

37. The aromatic polycarbonate resin as claimed in claim 34, wherein said substituent of said alkyl group represented by $R^1$ and $R^2$ is selected from the group consisting of a fluorine atom, cyano group, and a phenyl group which may have a substituent selected from the group consisting of a halogen atom and an alkyl group having 1 to 5 carbon atoms.

38. The aromatic polycarbonate resin as claimed in claim 34, wherein said aromatic hydrocarbon group represented by $R^1$ and $R^2$ is selected from the group consisting of phenyl group, a fused polycyclic group, and a non-fused polycyclic group.

39. The aromatic polycarbonate resin as claimed in claim 38, wherein said fused polycyclic group is selected from the group consisting of naphthyl group, pyrenyl group, 2-fluorenyl group, 9,9-dimethyl-2-fluorenyl group, azulenyl group, anthryl group, triphenylenyl group, chrysenyl group, fluorenylidenephenyl group, and 5H-dibenzo[a,d]cycloheptenylidenephenyl group.

40. The aromatic polycarbonate resin as claimed in claim 38, wherein said non-fused polycyclic group is selected from the group consisting of biphenylyl group, terphenylyl group and a group of formula (IX):

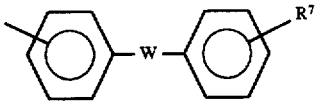

(IX)

wherein $R^7$ is selected from the group consisting of a halogen atom, a substituted or unsubstituted alkyl group having 1 to 12 carbon atoms, a substituted or unsubstituted alkoxyl group having 1 to 12 carbon atoms, a substituted or unsubstituted aryloxy group, a substituted mercapto group, an arylmercapto group, an alkylenedioxy group, an alkylenedithio group, and a group of

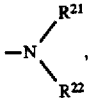

in which $R^{21}$ and $R^{22}$ each is an alkyl group or an aryl group; and W is selected from the group consisting of —O—, —S—, —SO—, —$SO_2$—, —CO—, and bivalent groups:

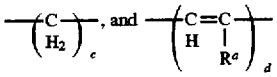

in which c is an integer of 1 to 12; d is an integer of 1 to 3; and $R^0$ is a hydrogen atom, a substituted or unsubstituted alkyl group, or a substituted or unsubstituted atomatic hydrocarbon group.

41. The aromatic polycarbonate resin as claimed in claim 34, wherein said substituent of said aromatic hydrocarbon group represented by $R^1$ and $R^2$ is selected from the group consisting of a halogen atom, a substituted or unsubstituted alkyl group having 1 to 12 carbon atoms, a substituted or unsubstituted alkoxyl group having 1 to 12 carbon atoms, a substituted or unsubstituted aryloxy group, a substituted mercapto group, an arylmercapto group, an alkylenedioxy group, an alkylenedithio group, and a group of

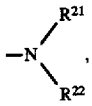

in which $R^{21}$ and $R^{22}$ each is an alkyl group or an aryl group.

42. The aromatic polycarbonate resin as claimed in claim 34, wherein said heterocyclic group represented by $R^1$ and $R^2$ is selected from the group consisting of thienyl group, benzothienyl group, furyl group, benzofuranyl group, and carbazolyl group.

43. The aromatic polycarbonate resin as claimed in claim 34, wherein said substituent of said heterocyclic group represented by $R^1$ and $R^2$ is selected from the group consisting of a halogen atom, a substituted or unsubstituted alkyl group having 1 to 12 carbon atoms, a substituted or unsubstituted alkoxyl group having 1 to 12 carbon atoms, a substituted or unsubstituted aryloxy group, a substituted mercapto group, an arylmercapto group, an alkylenedioxy group, an alkylenedithio group, and a group of

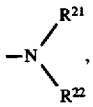

in which $R^{21}$ and $R^{22}$ each is an alkyl group or an aryl group.

44. The aromatic polycarbonate resin as claimed in claim 34, wherein said bivalent aromatic hydrocarbon group represented by $Ar^1$, $Ar^2$ and $Ar^3$ is phenylene group.

* * * * *

UNITED STATES PATENT AND TRADEMARK OFFICE

CERTIFICATE OF CORRECTION

PATENT NO. : 5,723,243
DATED : MARCH 3, 1998
INVENTOR(S) : MASAOMI SASAKI, ET AL.

It is certified that error appears in the above-identified patent and that said Letters Patent is hereby corrected as shown below:

Column 15, line 11, "id" should read --is--.

Column 18, line 21, "aa" should read --as--.
line 27, "it" should read --is--.

Column 19 line 10, "his" should read --this--.

Column 27 line 6, "wets" should read --were--.

Column 42 line 36, "luminance" should read --illuminance--.

Signed and Sealed this

Twenty-third Day of February, 1999

*Attest:*

Q. TODD DICKINSON

*Attesting Officer*

*Acting Commissioner of Patents and Trademarks*